US008485151B2

(12) United States Patent
Morishima

(10) Patent No.: US 8,485,151 B2
(45) Date of Patent: Jul. 16, 2013

(54) VALVE TIMING ADJUSTING DEVICE

(75) Inventor: Shingo Morishima, Toyota (JP)

(73) Assignee: Denso Corporation, Kariya (JP)

( * ) Notice: Subject to any disclaimer, the term of this patent is extended or adjusted under 35 U.S.C. 154(b) by 246 days.

(21) Appl. No.: 13/156,423

(22) Filed: Jun. 9, 2011

(65) Prior Publication Data

US 2011/0303170 A1 Dec. 15, 2011

(30) Foreign Application Priority Data

Jun. 11, 2010 (JP) ..... 2010-134323

(51) Int. Cl.
*F01L 1/34* (2006.01)

(52) U.S. Cl.
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS

| | | | | |
|---|---|---|---|---|
| 5,108,198 | A | 4/1992 | Nii et al. | |
| 8,245,679 | B2 * | 8/2012 | Morishima | 123/90.17 |
| 2010/0095920 | A1 | 4/2010 | Morishima | |

FOREIGN PATENT DOCUMENTS

| | | | |
|---|---|---|---|
| JP | A-55-54765 | | 4/1980 |
| JP | U-57-193454 | | 12/1982 |
| JP | A-61-189368 | | 8/1986 |
| JP | 3-51514 | | 3/1991 |
| JP | U-5-19741 | | 3/1993 |
| JP | P2004-011899 | A | 1/2004 |
| JP | 2008-51093 | | 3/2008 |
| JP | P2010-065736 | A | 3/2010 |
| JP | 2010-121613 | | 6/2010 |
| JP | 2010-121614 | | 6/2010 |

OTHER PUBLICATIONS

Japanese Office Action dated May 8, 2012, issued in corresponding Japanese Application No. 2010-134323, with English translation.

* cited by examiner

*Primary Examiner* — Ching Chang
(74) *Attorney, Agent, or Firm* — Nixon & Vanderhye P.C.

(57) ABSTRACT

A sealing structure seals a clearance between a housing and a brake rotor. The housing defines a fluid chamber for sealing a magnetic viscous fluid inside. The brake rotor penetrates through the housing and generates brake torque by contacting the magnetic viscous fluid. The housing has a magnetic sleeve section and a magnetic screw section provided to the brake rotor. The magnetic sleeve section is continuous in a rotational direction of the brake rotor and generates a magnetic flux. The magnetic screw section is an external screw having a screw thread, which extends away from a fluid chamber side toward a phase adjusting mechanism side when traced in a rotational direction of the brake rotor. The magnetic flux is guided to the magnetic screw section through a sealing gap between the magnetic screw section and an inner peripheral section of the magnetic sleeve section.

8 Claims, 13 Drawing Sheets

VALVE TIMING ADJUSTING DEVICE

CROSS REFERENCE TO RELATED APPLICATION

This application is based on and incorporates herein by reference Japanese Patent Application No. 2010-134323 filed on Jun. 11, 2010.

BACKGROUND OF THE INVENTION

1. Field of the Invention

The present invention relates to a valve timing adjusting device that adjusts valve timing of an actuated valve, which is opened and closed by a camshaft using torque transmitted from a crankshaft, in an internal combustion engine.

2. Description of Related Art

Conventionally, there has been known a valve timing adjusting device adjusting a relative phase (engine phase) between a crankshaft and a camshaft, which decides valve timing, according to brake torque generated by an actuator. As a kind of such the valve timing adjusting device, Patent document 1 (JP-A-2008-51093) describes a device that adjusts an engine phase by generating brake torque using an actuator.

More specifically, the actuator described in Patent document 1 passes a magnetic flux through a magnetic viscous fluid that is sealed in a fluid chamber inside a housing and that contacts a brake rotor, thereby variably controlling viscosity of the magnetic viscous fluid. With such the actuator, brake torque corresponding to the viscosity of the magnetic viscous fluid is inputted to the brake rotor that rotates in a constant direction. Therefore, a phase adjusting mechanism linked with the brake rotor adjusts the engine phase in accordance with the brake torque.

Specifically in the actuator of Patent document 1, the brake rotor is penetrated through the housing between an inside and an outside of the housing in order to link the brake rotor inside the housing with the phase adjusting mechanism outside the housing. Therefore, in order to inhibit a situation where the magnetic viscous fluid leaks from the fluid chamber inside the housing to the outside of the housing and changes input characteristics of the brake torque, a sealing structure using an oil seal or magnetic poles is provided between the housing and the brake rotor. If the change in the input characteristics of the brake torque is suppressed, fluctuation in adjustment characteristics of the engine phase, which follow the brake torque, becomes less apt to occur. Therefore, reliability can be secured.

In order to suppress the leakage of the magnetic viscous fluid by exerting the sealing action in the sealing structure using the oil seal in the actuator of Patent document 1, it is necessary to strengthen tension of the oil seal applied to the brake rotor. However, if the tension is strengthened, wear can be caused in the oil seal by friction resistance, thereby deteriorating durability.

In the case of the sealing structure using the magnetic poles in the actuator of Patent document 1, it is essential to provide a certain clearance to allow rotation of the brake rotor between a magnetized portion of the brake rotor forming the magnetic poles and a bearing of the housing. Therefore, there is a possibility that the leakage of the magnetic viscous fluid to the outside of the housing through the clearance between the magnetized portion and the bearing cannot be suppressed sufficiently, thereby causing a bottleneck against improvement of sealing performance.

SUMMARY OF THE INVENTION

It is an object of the present invention to provide a valve timing adjusting device securing both of durability and reliability at the same time.

According to a first example aspect of the present invention, a valve timing adjusting device adjusts valve timing of an actuated valve, which is opened and closed by a camshaft using torque transmitted from a crankshaft, in an internal combustion engine. The valve timing adjusting device has a housing, a magnetic viscous fluid, a viscosity controlling section, a brake rotor, a phase adjusting mechanism, and a sealing structure. The housing defines a fluid chamber inside. The magnetic viscous fluid is sealed in the fluid chamber and has viscosity changing in accordance with a magnetic flux passing through the fluid. The viscosity controlling section variably controls the viscosity of the magnetic viscous fluid by passing the magnetic flux through the magnetic viscous fluid in the fluid chamber. The brake rotor penetrates through the housing between an inside and an outside of the housing and rotates in a constant direction due to an operation of the internal combustion engine. Brake torque corresponding to the viscosity of the magnetic viscous fluid in the fluid chamber is inputted to the brake rotor through contact between the brake rotor and the magnetic viscous fluid. The phase adjusting mechanism is linked with the brake rotor outside the housing and adjusts a relative phase between the crankshaft and the camshaft (i.e., engine phase) in accordance with the brake torque inputted to the brake rotor. The sealing structure seals a clearance between the housing and the brake rotor.

The sealing structure has a magnetic sleeve section and a magnetic screw section. The magnetic sleeve section is provided in the housing to be continuous in the rotational direction of the brake rotor and generates the magnetic flux. The magnetic screw section is provided to the brake rotor such that a sealing gap is formed between the magnetic screw section and an inner peripheral section of the magnetic sleeve section. The magnetic screw section is formed in the shape of an external screw having a screw thread, which extends away from the fluid chamber side toward the phase adjusting mechanism side when the screw thread is traced along the rotational direction of the brake rotor. The magnetic flux generated by the magnetic sleeve section is guided to the magnetic screw section through the sealing gap.

With such the construction, the sealing gap is provided between the magnetic screw section of the brake rotor, which penetrates through the housing between the inside and the outside of the housing, and the inner peripheral section of the magnetic sleeve section, which is continuous in the rotational direction of the brake rotor in the housing. The magnetic flux generated by the magnetic sleeve section is guided to the magnetic screw section through the sealing gap. Therefore, the magnetic viscous fluid easily flows into the sealing gap from the fluid chamber in the housing because of magnetic attraction. Moreover, since the magnetic flux generated by the magnetic sleeve section is guided to the magnetic screw section in the shape of the external screw through the sealing gap, into which the magnetic viscous fluid has flown, the viscosity of the magnetic viscous fluid increases and the magnetic viscous fluid is trapped into the shape of a membrane between the screw thread of the magnetic screw section and the inner peripheral section of the magnetic sleeve section. The sealing membrane formed in the sealing gap in this way is free from wear resulting from friction resistance and can exert a self-sealing function to suppress leakage of the magnetic viscous fluid toward the phase adjusting mechanism outside the housing by itself.

The magnetic screw section in the shape of the external screw having the screw thread, which extends away from the fluid chamber side toward the phase adjusting mechanism side when traced along the rotational direction of the brake rotor, can apply a moment heading to the fluid chamber side to the magnetic viscous fluid in the sealing gap between the magnetic screw section and the magnetic sleeve section. It is because of exertion of a screw-type rotational labyrinth sealing function as a combination of a hydrodynamic effect of drawing the magnetic viscous fluid from the phase adjusting mechanism side outside the housing (as low-pressure side) toward the fluid chamber side inside the housing (as high-pressure side) and a viscosity effect corresponding to the increase of the viscosity. Accordingly, with such the labyrinth sealing function, during an operation of the internal combustion engine, in which the brake rotor rotates in a constant direction, the magnetic viscous fluid can be pushed back toward the fluid chamber side against the leak flow heading to the phase adjusting mechanism side.

Thus, as the result of the exertion of the self-sealing function and the labyrinth sealing function, the durability can be secured by avoiding the wear and the reliability can be secured by avoiding the change in the input characteristics of the brake torque due to the leakage of the magnetic viscous fluid at the same time.

According to a second example aspect of the present invention, the magnetic viscous fluid sealed in the fluid chamber is prepared by dispersing magnetic particulates in a nonmagnetic base liquid. The magnetic viscous fluid sealed in the fluid chamber can exert the self-sealing function and the labyrinth function since the magnetic particulates are magnetically attracted to the sealing gap, to which the magnetic flux is guided. In addition, the labyrinth sealing function in the sealing gap can be applied also to the nonmagnetic base liquid, which is not attracted magnetically. With such the construction, the magnetic fluid and the nonmagnetic base liquid as ingredients of the magnetic viscous fluid can be avoided from causing the leakage to the outside of the housing, which can cause the change in the input characteristics of the brake torque. Thus, the reliability can be secured.

According to a third example aspect of the present invention, the magnetic screw section is a parallel screw type. The inner peripheral section of the magnetic sleeve section, which forms the sealing gap with the magnetic screw section, extends straight in an axial direction from its first axial end portion on a phase adjusting mechanism side toward a fluid chamber side. An internal diameter of a second axial end portion of the inner peripheral section on the fluid chamber side is set equal to or larger than an internal diameter of the other portion of the inner peripheral section. In this way, the portion of the inner peripheral section of the magnetic sleeve section extending straight axially from its axial end portion on the phase adjusting mechanism side toward the fluid chamber side can be arranged as close as possible to the screw thread of the magnetic screw section of the parallel screw type. Thus, the sealing gap between the inner peripheral section of the magnetic sleeve section and the magnetic screw section can be formed narrow. In such the narrow sealing gap, the high labyrinth sealing function is exerted, and the magnetic viscous fluid is easily pushed back to the fluid chamber side. Moreover, the axial end portion of the inner peripheral section of the magnetic sleeve section on the fluid chamber side having the internal diameter equal to or larger than the internal diameter of the other portion does not block the pushing back of the magnetic viscous fluid toward the fluid chamber side. With such the construction, the change in the input characteristics of the brake torque due to the leakage of the magnetic viscous fluid can be surely avoided, thereby securing the high reliability.

According to a fourth example aspect of the present invention, the inner peripheral section of the magnetic sleeve section, which forms the sealing gap with the magnetic screw section of the parallel screw type, extends straight over an entire axial range extending from its first axial end portion on the phase adjusting mechanism side to its second axial end portion on the fluid chamber side. In this way, the inner peripheral section of the magnetic sleeve section extending straight over the entire axial range from its axial end portion on the phase adjusting mechanism side to its axial end portion on the fluid chamber side can be arranged as close as possible to the screw thread of the magnetic screw section of the parallel screw type. Thus, the sealing gap between the inner peripheral section and the magnetic screw section can be formed narrow. Such the sealing gap secured to be narrow in the range corresponding to the entire axial range of the magnetic sleeve section can exert a higher labyrinth sealing function, so the magnetic viscous fluid can be pushed back to the fluid chamber side more easily. In addition, the internal diameter of the inner peripheral section of the magnetic sleeve section extending straight over its entire axial range is constant over the entire range. Therefore, the inner peripheral section does not block the pushing back of the magnetic viscous fluid toward the fluid chamber side. With such the construction, the change in the input characteristics of the brake torque due to the leakage of the magnetic viscous fluid can be surely avoided, and the high reliability can be secured.

According to a fifth example aspect of the present invention, the sealing structure has a nonmagnetic annular section that is coaxially adjacent to an axial end portion of the magnetic sleeve section on the phase adjusting mechanism side and that surrounds an outer peripheral side of the magnetic screw section. With such the construction, the labyrinth sealing function is exerted during the operation of the internal combustion engine also in a gap between the nonmagnetic annular section, which is coaxially adjacent to the axial end portion of the magnetic sleeve section on the phase adjusting mechanism side, and the magnetic screw section, whose outer peripheral side is surrounded by the nonmagnetic annular section. Therefore, even if the magnetic viscous fluid leaks from the sealing gap between the magnetic sleeve section and the magnetic screw section to the phase adjusting mechanism side, the leaked magnetic viscous fluid can be pushed back to the sealing gap by the exertion of the labyrinth function between the nonmagnetic annular section and the magnetic screw section on the phase adjusting mechanism side. Moreover, because of the nonmagnetic annular section, the magnetic flux generated by the magnetic sleeve section can be surely guided to the sealing gap while leakage from the sleeve section to the phase adjusting mechanism side is suppressed. Accordingly, the self-sealing function also improves. With such the construction, the change in the input characteristics of the brake torque due to the leakage of the magnetic viscous fluid can be surely avoided, thereby securing the high reliability.

According to a sixth example aspect of the present invention, the magnetic sleeve section has a cylindrical permanent magnet and a pair of magnetic yokes in the shape of annular plates. The permanent magnet is provided coaxially with the magnetic screw section and generates the magnetic flux using magnetic poles formed by both axial end portions thereof. The pair of magnetic yokes are coaxially adjacent to the both axial end portions of the permanent magnet respectively and guide the magnetic flux generated by the permanent magnet to the sealing gap between the magnetic sleeve section and the magnetic screw section. In such the magnetic sleeve section, the magnetic flux generated by the both axial end portions of the cylindrical permanent magnet, which is arranged coaxially with the magnetic screw section, using the respective magnetic poles is guided to the sealing gap between the magnetic sleeve section and the magnetic screw section in a concentrated manner from the respective magnetic yokes in the shape of annular plates coaxially adjacent to the both end portions of the permanent magnet. With such the guiding action, a passage density of the magnetic flux increases in the sealing gap between the magnetic yokes and the magnetic screw section. As a result, pressure resistance and the self-sealing function of the sealing membrane can be improved by the increase of the viscosity of the magnetic viscous fluid. Thus, the change in the input characteristics of the brake torque due to the leakage of the magnetic viscous fluid can be avoided and the reliability can be secured.

According to a seventh example aspect of the present invention, the magnetic screw section is arranged over a range bridging the magnetic yoke along the axial direction radially inside the magnetic yoke. The magnetic screw section arranged over the range bridging the magnetic yoke in the shape of the annular plate along the axial direction radially inside the magnetic yoke in this way can face the magnetic yoke even if the magnetic screw section is deviated from a regular position in the axial direction. Accordingly, the self-sealing function can be invariably exerted by the sealing gap between the facing yoke and the magnetic screw section. With such the construction, the change in the input characteristics of the brake torque due to the leakage of the magnetic viscous fluid can be surely avoided and the high reliability can be secured.

According to an eighth example aspect of the present invention, the magnetic yoke has axial thickness smaller than a pitch of the magnetic screw section. The magnetic yoke in the shape of the annular plate having the axial thickness smaller than the pitch of the magnetic screw section in this way facilitates the concentration of the magnetic flux to the sealing gap between the magnetic yoke and the screw section. With such the concentrating action of the magnetic flux, the passage density of the magnetic flux in the sealing gap can be heightened locally. Thus, the pressure resistance and the self-sealing function of the sealing membrane can be improved because of the increase of the viscosity of the magnetic viscous fluid. As a result, the change in the input characteristics of the brake torque due to the leakage of the magnetic viscous fluid can be surely avoided and the reliability can be secured.

According to a ninth example aspect of the present invention, the magnetic yoke has axial thickness equal to or larger than a pitch of the magnetic screw section. The magnetic yoke having the axial thickness equal to or larger than the pitch of the magnetic screw section can form multiple stages of the sealing membranes between the magnetic yoke and axially-arranged multiple points of the screw thread of the external screw of the screw section in the sealing gap between the magnetic yoke and the screw section. With such the multiple stages of the sealing membranes, the pressure resistance and the self-sealing function of the total membranes can be improved. Accordingly, the change in the input characteristics of the brake torque due to the leakage of the magnetic viscous fluid can be surely avoided and the high reliability can be secured.

According to a tenth example aspect of the present invention, the magnetic sleeve section has a cylindrical permanent magnet that is arranged coaxially with the magnetic screw section and that generates a magnetic flux using magnetic poles formed by an inner peripheral section and an outer peripheral section thereof. In such the magnetic sleeve section, the magnetic flux generated by the inner peripheral section and the outer peripheral section of the cylindrical permanent magnet, which is arranged coaxially with the magnetic screw section, using the respective magnetic poles is guided to the magnetic screw section from the inner peripheral section through the sealing gap. With such the guiding action, the viscosity increase of the magnetic viscous fluid is caused by the passage of the magnetic flux in the sealing gap extending along the inner peripheral section of the magnetic sleeve section. Therefore, the labyrinth sealing function as the combination of the viscosity effect and the hydrodynamic effect can be heightened. Accordingly, the change in the input characteristics of the brake torque due to the leakage of the magnetic viscous fluid can be avoided and the reliability can be secured.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF EXAMPLE EMBODIMENT

Hereinafter, embodiments of the present invention will be described with reference to the drawings.

The same sign is used for equivalent constituents in the following description of the embodiments, thereby avoiding redundant explanation. When only a part is explained in description of a construction of a certain embodiment, a construction of a preceding embodiment can be applied to the other unexplained part of the construction of the certain embodiment. In addition to combination of the constructions clearly specified in the explanation of the embodiments, the constructions of the embodiments may be combined partly with each other as long as the combination does not cause any specific problem.

First Embodiment

Figure 1:
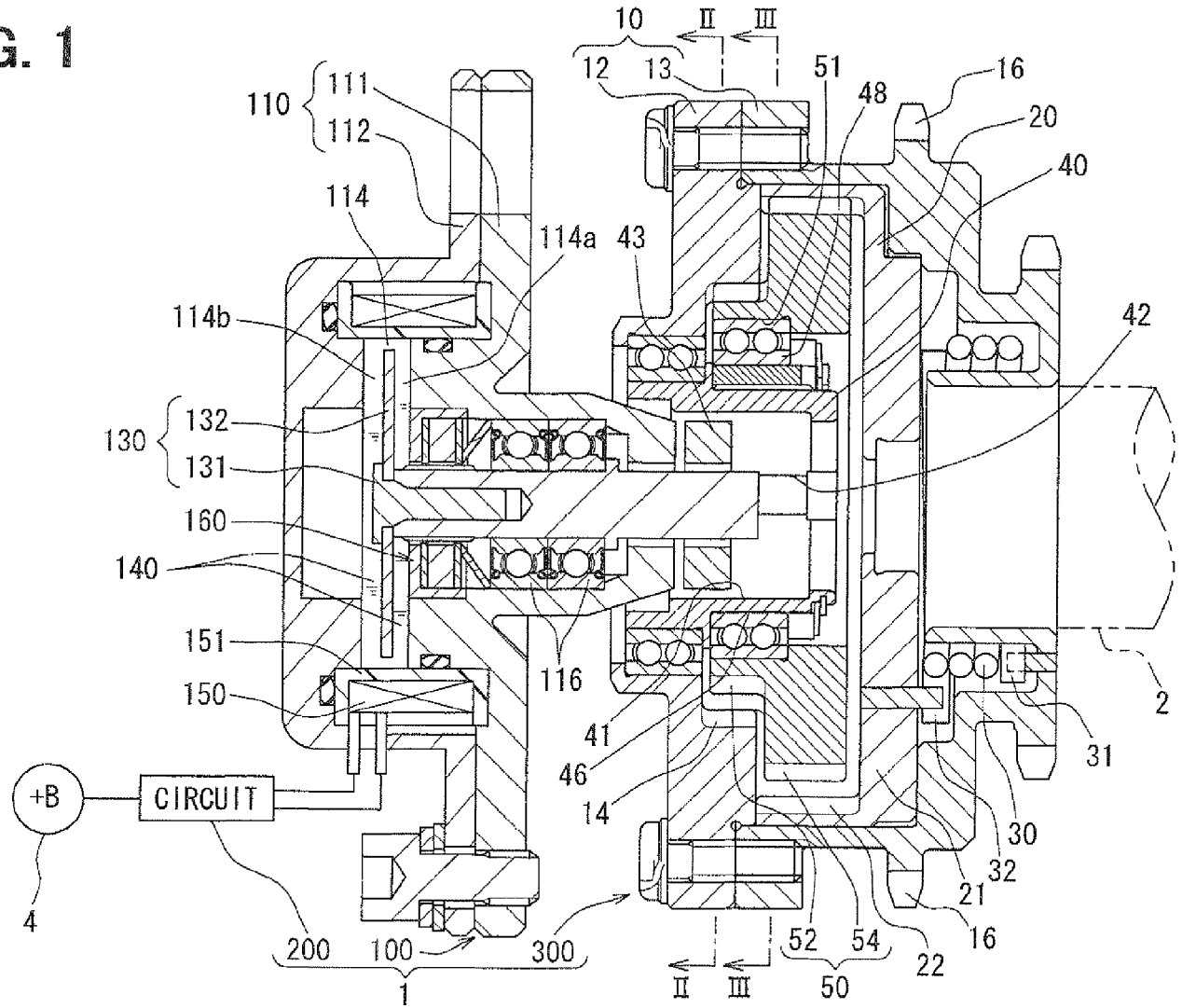
FIG. 1 is a cross-sectional view showing a valve timing adjusting device according to a first embodiment of the present invention.

FIG. 1 shows a valve timing adjusting device 1 according to a first embodiment of the present invention. The valve timing adjusting device 1 is mounted in a vehicle and is arranged in a transmission system that transmits engine torque from a crankshaft (not shown) of an internal combustion engine to a camshaft 2. The camshaft 2 opens and closes an intake valve (not shown) among actuated valves of the internal combustion engine using the transmission of the engine torque. The valve timing adjusting device 1 adjusts valve timing of the intake valve.

Figure 2:
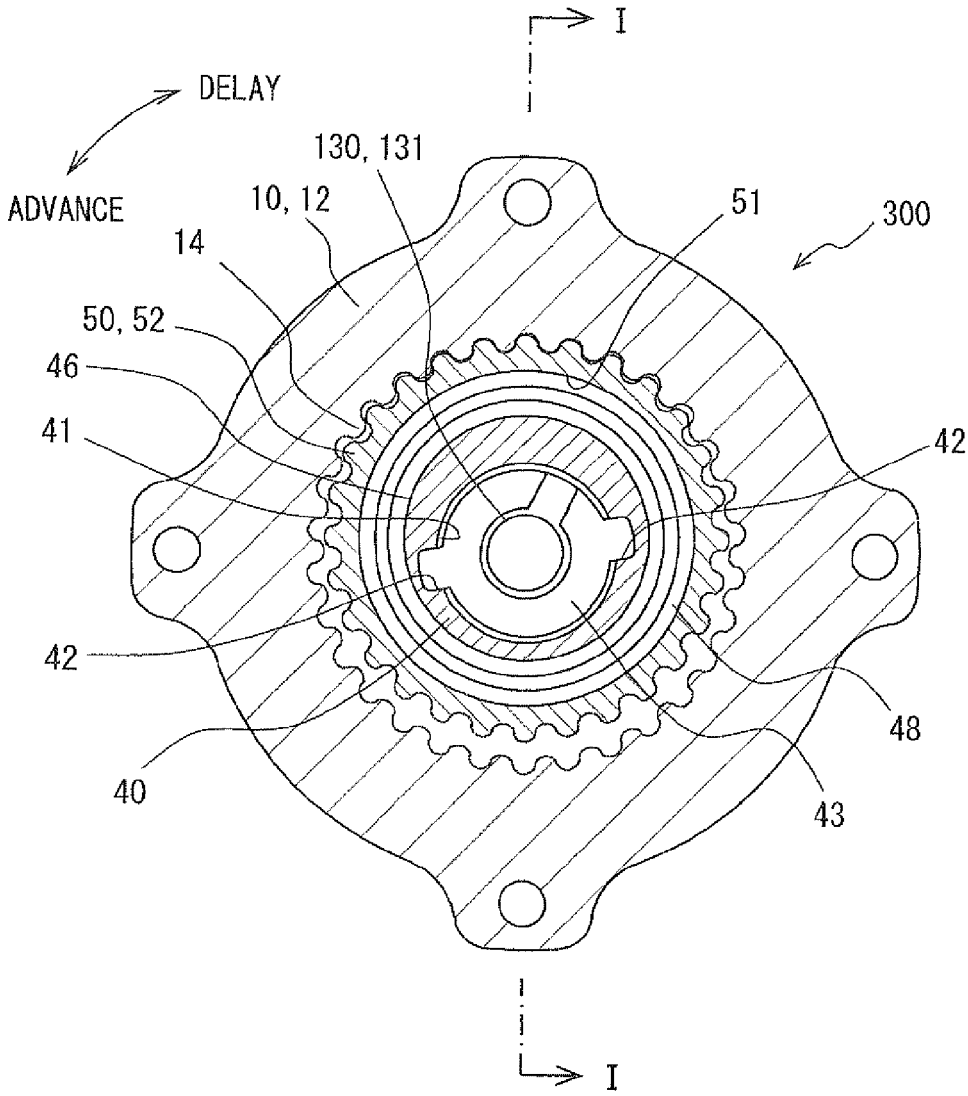
FIG. 2 is a cross-sectional view showing the valve timing adjusting device of FIG. 1 taken along the line II-II.
Figure 3:
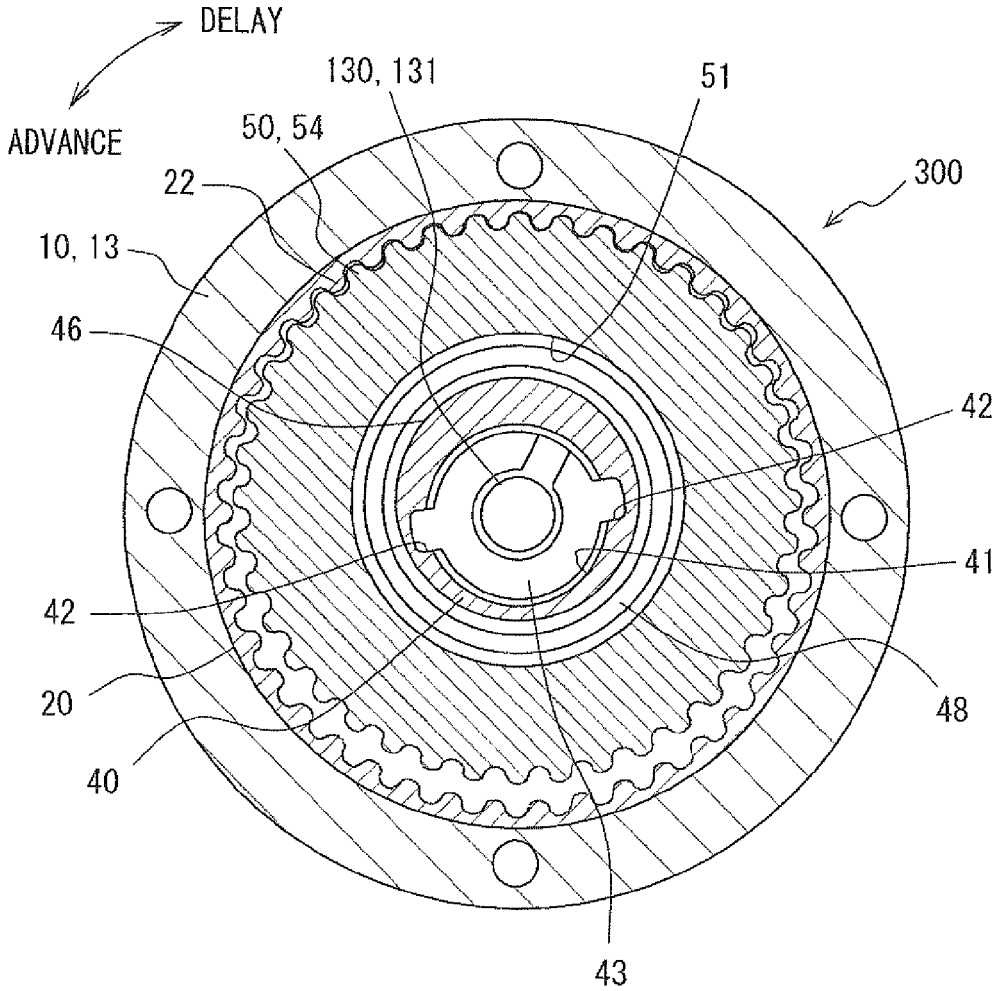
FIG. 3 is a cross-sectional view showing the valve timing adjusting device of FIG. 1 taken along the line III-III.

As shown in FIGS. 1 to 3, the valve timing adjusting device 1 is constructed by combining an actuator 100, an energization control circuit 200, a phase adjusting mechanism 300 and the like. The valve timing adjusting device 1 realizes desired valve timing by adjusting an engine phase as a relative phase of the camshaft 2 with respect to the crankshaft.

(Actuator)

As shown in FIG. 1, the actuator 100 is an electric fluid brake. The actuator 100 has a housing 110, a brake rotor 130, a magnetic viscous fluid 140, a sealing structure 160 and a solenoid coil 150.

The housing 110 is formed in a hollow shape as a whole and has a fixing member 111 and a cover member 112. The cylindrical fixing member 111 is made of a magnetic material and is fixed to a chain case (not shown) that is a fixed node of the internal combustion engine. The cover member 112 in the shape of a round cup is made of a magnetic material having a property, that is the same as or different from a property of the magnetic material of the fixing member 111. The cover member 112 is arranged on a side of the fixing member 111 opposite to the phase adjusting mechanism 300 with respect to an axial direction. The cover member 112 is fixed to the fixing member 111 coaxially and liquid-tightly. A space formed between the cover member 112 and the fixing member 111 as an inside of the housing 110 defines a fluid chamber 114.

The brake rotor 130 is made of a magnetic material and has a shaft section 131 and a rotor section 132. The shaft section 131 in the shape of a shaft penetrates through the fixing member 111 of the housing 110 on the phase adjusting mechanism 300 side between an inside and an outside. An axial end portion of the shaft section 131 outside the housing 110 is linked with the phase adjusting mechanism 300. An axially-middle portion of the shaft section 131 is rotatably supported by a bearing section 116 provided in the fixing member 111 of the housing 110. With such the construction, the brake rotor 130 rotates in a constant direction (refer to sign R in FIGS. 5 to 7) that is a counterclockwise direction in FIGS. 2 and 3 when the engine torque outputted from the crankshaft during an operation of the internal combustion engine is transmitted from the phase adjusting mechanism 300.

As shown in FIG. 1, the rotor section 132 formed in the shape of an annular plate extends from an axial end portion of the shaft section 131 on a side opposite to the phase adjusting mechanism 300 to an outer peripheral side coaxially with the shaft section 131. The rotor section 132 is accommodated in the fluid chamber 114 inside the housing 110. Because of such the accommodation, the fluid chamber 114 has a space sandwiched between the rotor section 132 and the fixing member 111 in the axial direction as a magnetic gap 114*a* and a space sandwiched between the rotor section 132 and the cover member 112 in the axial direction as a magnetic gap 114*b*.

Figure 4:
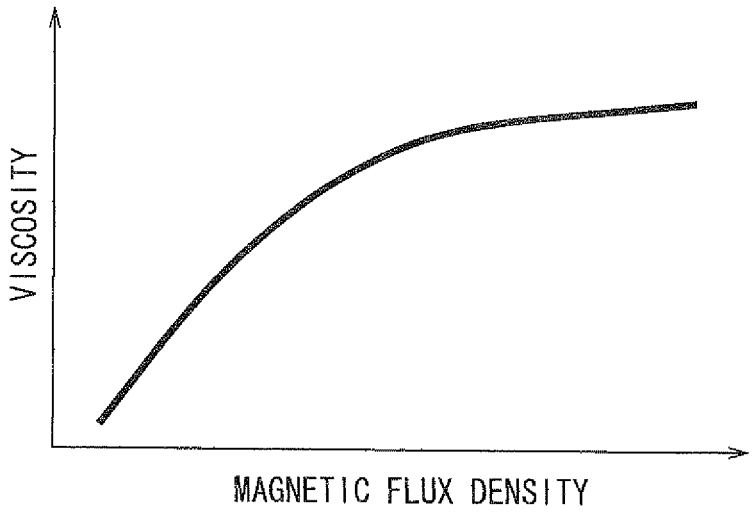
FIG. 4 is a characteristic diagram showing a characteristic of a magnetic viscous fluid according to the first embodiment.

The magnetic viscous fluid 140 is sealed in the fluid chamber 114 having the magnetic gaps 114*a*, 114*b*. The magnetic viscous fluid 140 as a kind of functional fluid is prepared by dispersing magnetic particulates in a nonmagnetic base liquid into a suspended state. A nonmagnetic liquid material such as oil is used as the base liquid of the magnetic viscous fluid 140. More preferably, oil of the same kind as lubrication oil of the internal combustion engine is used. A particulate magnetic material such as carbonyl iron is used as the magnetic particulates of the magnetic viscous fluid 140, for example. The magnetic viscous fluid 140 having such the component construction has characteristics that, due to passage of a magnetic flux, apparent viscosity of the magnetic viscous fluid 140 changes and increases as shown in FIG. 4 to follow density of the passing magnetic flux, and yield stress of the magnetic viscous fluid 140 increases in proportion to the viscosity.

The sealing structure 160 shown in FIG. 1 is provided at a position between the fluid chamber 114 and the bearing section 116 in the axial direction common to the housing 110 and the brake rotor 130. The sealing structure 160 seals a clearance between the fixing member 111 of the housing 110 and the shaft section 131 of the brake rotor 130, thereby suppressing leakage of the magnetic viscous fluid 140 to the outside of the housing 110.

The solenoid coil 150 is formed by winding a metal wire on a resin bobbin 151 and is provided coaxially on an outer peripheral side of the rotor section 132, The solenoid coil 150 is held by the housing 110 in a state where the solenoid coil 150 is sandwiched between the fixing member 111 and the cover member 112 in the axial direction. If the solenoid coil 150 held in such the manner is energized, the solenoid coil 150 generates a magnetic flux that passes through the fixing member 111, the magnetic gap 114*a*, the rotor section 132, the magnetic gap 114*b* and the cover member 112 in series.

Therefore, when the solenoid coil 150 generates the magnetic flux by the energization during the operation of the internal combustion engine, during which the brake rotor 130 rotates counterclockwise in FIGS. 2 and 3, the generated magnetic flux passes through the magnetic viscous fluid 140 in the magnetic gaps 114*a*, 114*b* in the fluid chamber 114. As a result, brake torque occurs in a clockwise direction in FIGS. 2 and 3 to brake the brake rotor 130 (rotor section 132) due to an action of viscous resistance between the elements 110, 130 contacting the magnetic viscous fluid 140, whose viscosity has changed. In this way, according to the present embodiment, when the solenoid coil 150 is energized to pass the magnetic flux through the magnetic viscous fluid 140 of the fluid chamber 114, the brake torque corresponding to the viscosity of the magnetic viscous fluid 140 can be inputted to the brake rotor 130.

(Energization Control Circuit)

The energization control circuit 200 is mainly constructed of a microcomputer. The energization control circuit 200 is arranged outside the actuator 100 and is electrically connected with the solenoid coil 150 and a vehicle battery 4.

When the internal combustion engine is stopped, power supply from the battery 4 to the energization control circuit 200 is blocked, so the energization control circuit 200 cuts the energization to the solenoid coil 150. Therefore, at that time, the solenoid coil 150 does not generate the magnetic flux, so the brake torque inputted to the brake rotor 130 disappears.

During the operation of the internal combustion engine, the energization control circuit 200 controls an energization current supplied to the solenoid coil 150 under the power supply from the battery 4, thereby generating the magnetic flux to be passed through the magnetic viscous fluid 140. Therefore, at that time, the viscosity of the magnetic viscous fluid 140 is variably controlled such that the brake torque inputted to the brake rotor 130 is increased or decreased to follow the energization current supplied to the solenoid coil 150.

(Phase Adjusting Mechanism)

The phase adjusting mechanism 300 shown in FIGS. 1 to 3 has a driving rotor 10, a driven rotor 20, an assisting member 30, a planetary carrier 40 and a planetary gear 50.

The driving rotor 10 substantially in the shape of a cylinder as a whole is formed by screwing a gear member 12 and a sprocket member 13 coaxially. As shown in FIGS. 1 and 2, the gear member 12 in the shape of an annular plate has a driving inner gear section 14 on its peripheral wall section. The driving inner gear section 14 has an addendum circle having a diameter smaller than a diameter of a root circle. As shown in FIG. 1, the cylindrical sprocket member 13 has multiple teeth 16, which protrude radially outward from a peripheral wall section and which are arranged along a rotational direction. A timing chain (not shown) is put around the teeth 16 and multiple teeth of the crankshaft, whereby the sprocket member 13 is linked with the crankshaft. With such the linkage, when the engine torque outputted from the crankshaft is transmitted to the sprocket member 13 via the timing chain, the driving rotor 10 rotates in conjunction with the crankshaft. At that time, the rotational direction of the driving rotor 10 is a counterclockwise direction in FIGS. 2 and 3.

As shown in FIGS. 1 and 3, the driven rotor 20 in the shape of a cylinder with a bottom is provided coaxially on an inner peripheral side of the sprocket member 13 of the driving rotor 10. The driven rotor 20 has a fixed portion 21 in its bottom wall section. The fixed portion 21 is fitted to an outside of the camshaft 2 and is fixed to the camshaft 2 coaxially by thread fixation. By such the fixation, the driven rotor 20 can rotate in conjunction with the camshaft 2 and relative to the driving rotor 10. The rotational direction of the driven rotor 20 is set at the counterclockwise direction in FIGS. 2 and 3 like the driving rotor 10.

As shown in FIG. 1, the driven rotor 20 has a driven inner gear section 22 on its peripheral wall section. The driven inner gear section 22 has an addendum circle having a diameter smaller than a diameter of a root circle. An internal diameter of the driven inner gear section 22 is set larger than an internal diameter of the driving inner gear section 14. The number of teeth of the driven inner gear section 22 is set larger than the number of teeth of the driving inner gear section 14. The driven inner gear section 22 is arranged to be deviated coaxially from the driving inner gear section 14 toward a side opposite to the actuator 100.

The assisting member 30 is provided by a twisted coil spring and is provided coaxially on an inner peripheral side of the sprocket member 13. One end portion 31 of the assisting member 30 is engaged with the sprocket member 13, and the other end portion 32 of the assisting member 30 is engaged with the fixed portion 21. The assisting member 30 deforms and twists between the rotors 10, 20 to generate assist torque, thereby biasing the driven rotor 20 to a delay side with respect to the driving rotor 10.

As shown in FIGS. 1 to 3, the planetary carrier 40 is formed in a cylindrical shape as a whole and has a transmission section 41 on its peripheral wall section. The brake torque is transmitted from the brake rotor 130 of the actuator 100 to the transmission section 41. The transmission section 41 is formed in the shape of a cylindrical hole provided coaxially with the rotors 10, 20 and the shaft section 131 of the brake rotor 130. The transmission section 41 has a pair of grooves 42 and is linked with the shaft section 131 through joints 43 fitted to the grooves 42. With such the linkage, the planetary carrier 40 can rotate integrally with the brake rotor 130 and relative to the driving rotor 10. The rotational direction of the planetary carrier 40 during the operation of the internal combustion engine is a counterclockwise direction in FIGS. 2 and 3 like the brake rotor 130.

As shown in FIGS. 1 to 3, the planetary carrier 40 has a bearing section 46 for rotatably supporting the planetary gear 50 on its peripheral wall section. The bearing section 46 is formed in the shape of a cylindrical surface decentered from the rotors 10, 20 and the shaft section 131 of the brake rotor 130. The bearing section 46 is fitted coaxially into a central hole 51 of the planetary gear 50 through a planetary bearing 48. With such the fitting, the planetary gear 50 is supported by the bearing section 46 such that the planetary gear 50 can perform sun-and-planet motion. The sun-and-planet motion means a motion, in which the planetary gear 50 revolves in the rotational direction of the planetary carrier 40 while the planetary gear 50 rotates around a central axis of the bearing section 46 decentered from the shaft section 131. Therefore, when the planetary carrier 40 rotates in the direction of the revolution of the planetary gear 50 relative to the driving rotor 10, the planetary gear 50 performs the sun-and-planet motion.

The planetary gear 50 is formed in the shape of a stepped cylinder as a whole and has outer gear sections 52, 54 on its peripheral wall section. Each of the outer gear sections 52, 54 has an addendum circle having a diameter larger than a diameter of a root circle. The driving outer gear section 52 is arranged on an inner peripheral side of the driving inner gear section 14 and is meshed with the driving inner gear section 14 on the decentered side of the bearing section 46 with respect to the shaft section 131. The driven outer gear section 54 is coaxially deviated from the driving outer gear section 52 toward a side opposite to the actuator 100 and is arranged on an inner peripheral side of the driven inner gear section 22. The driven outer gear section 54 is meshed with the driven inner gear section 22 on the decentered side of the bearing section 46 with respect to the shaft section 131. An external diameter of the driven outer gear section 54 is set larger than an external diameter of the driving outer gear section 52. The numbers of teeth of the driven outer gear section 54 and the driving outer gear section 52 are set smaller than the numbers of the teeth of the driven inner gear section 22 and the driving inner gear section 14 by the same number respectively.

The phase adjusting mechanism 300 having the above-described construction adjusts the engine phase in accordance with a balance among the brake torque inputted to the brake rotor 130, the assist torque of the assisting member 30, which acts on the brake rotor 130 in the direction opposite to the brake torque, and fluctuation torque transmitted from the camshaft 2 to the brake rotor 130.

More specifically, when the brake rotor 130 realizes the rotation at the same speed as the driving rotor 10 due to holding of the brake torque and the like, the planetary carrier 40 does not rotate relative to the driving rotor 10. As a result, the planetary gear 50 does not perform the sun-and-planet motion but rotates together with the rotors 10, 20. Therefore, the engine phase is held.

When the brake rotor 130 realizes the rotation at the lower speed than the driving rotor 10 against the assist torque due to the increase of the brake torque and the like, the planetary carrier 40 rotates to the delay side relative to the driving rotor 10. As a result, the planetary gear 50 performs the sun-and-planet motion, and the driven rotor 20 rotates to the advance side relative to the driving rotor 10. Therefore, the engine phase advances.

When the brake rotor 130 receives the assist torque and realizes the rotation at the higher speed than the driving rotor 10 due to the decrease of the brake torque and the like, the planetary carrier 40 rotates to the advance side relative to the driving rotor 10. As a result, the planetary gear 50 performs the sun-and-planet motion, and the driven rotor 20 rotates to the delay side relative to the driving rotor 10. Therefore, the engine phase delays.

(Sealing Structure)

Figure 5:
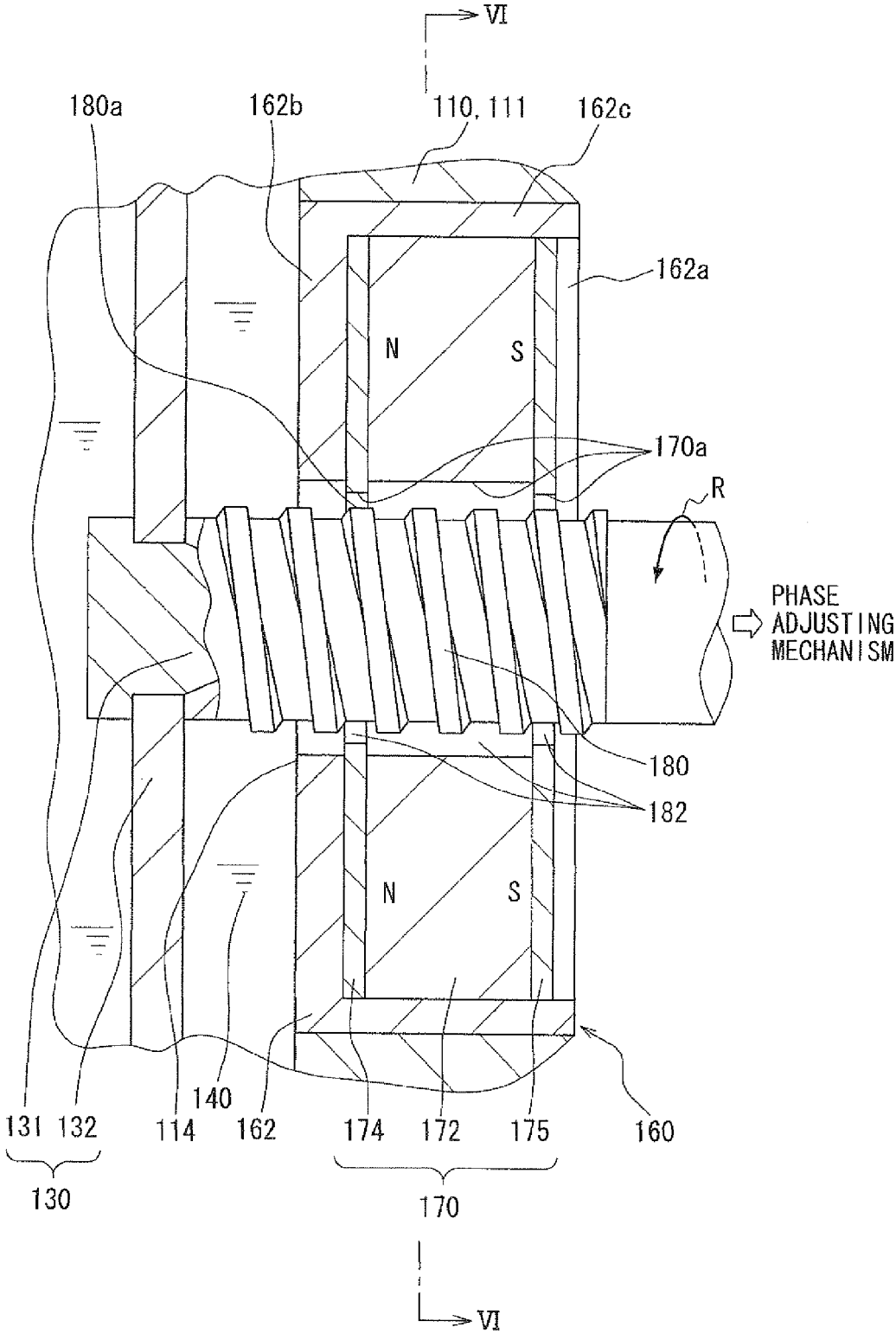
FIG. 5 is an enlarged cross-sectional view showing a substantial part of the valve timing adjusting device of FIG. 1.

The sealing structure 160 insulates the fluid chamber 114, which seals the magnetic viscous fluid 140 inside the housing 110, from the outside of the housing 110. As shown in FIG. 5, The sealing structure 160 has a shield section 162, a magnetic sleeve section 170 and a magnetic screw section 180.

The shield section 162 in the shape of a cylinder having a bottom is made of a nonmagnetic material such as austenitic stainless steel and is arranged on an outer peripheral side of the shaft section 131 of the brake rotor 130. The shield section 162 is fitted and fixed to an inner peripheral section of the fixing member 111 defining the housing 110 coaxially with the shaft section 131 such that an opening 162*a* of the shield section 162 faces the phase adjusting mechanism 300 side (bearing section 116 side) and a bottom portion 162*b* of the shield section 162 faces the fluid chamber 114 side respectively.

Figure 6:
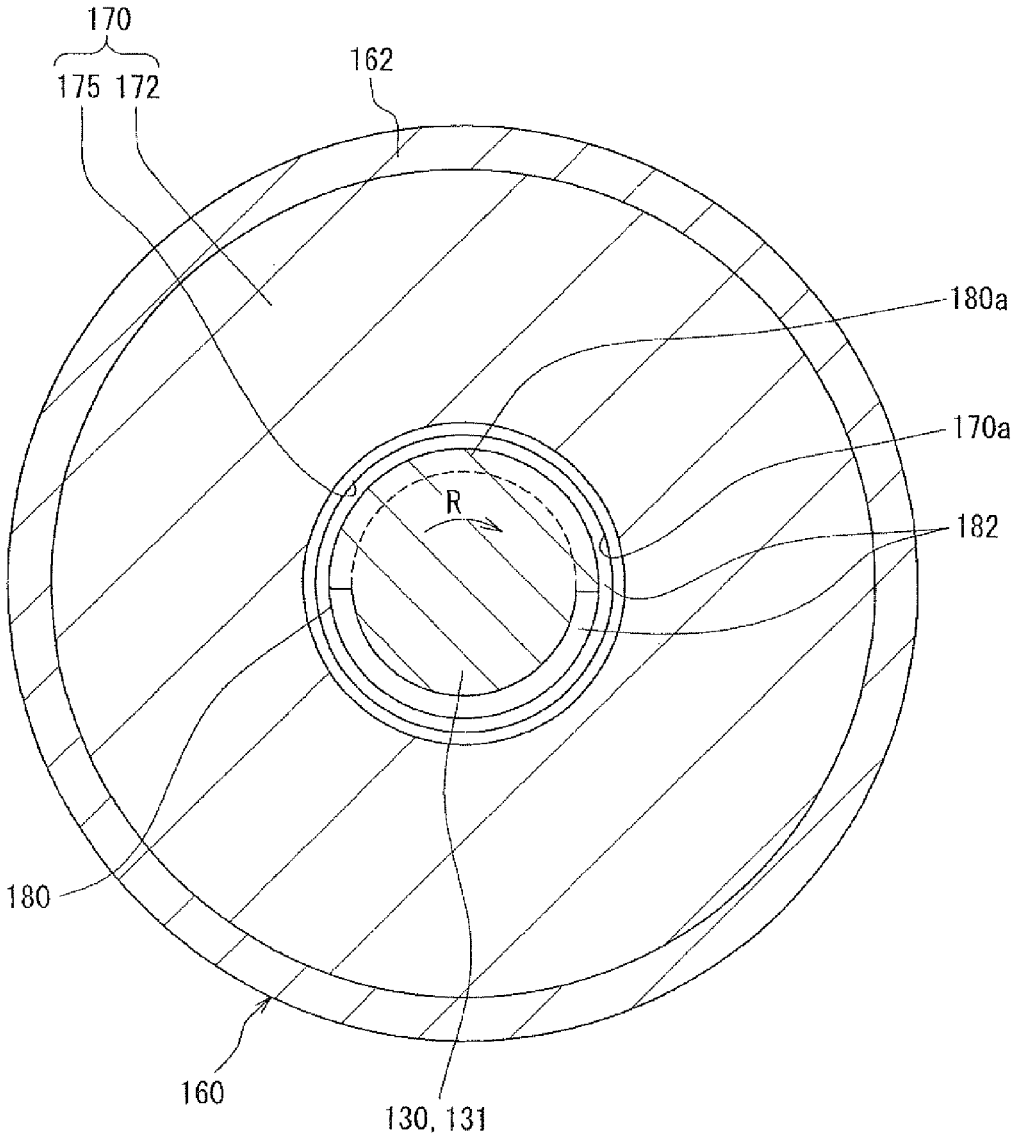
FIG. 6 is a cross-sectional view showing the valve timing adjusting device of FIG. 5 taken along the line VI-VI.
Figure 7:
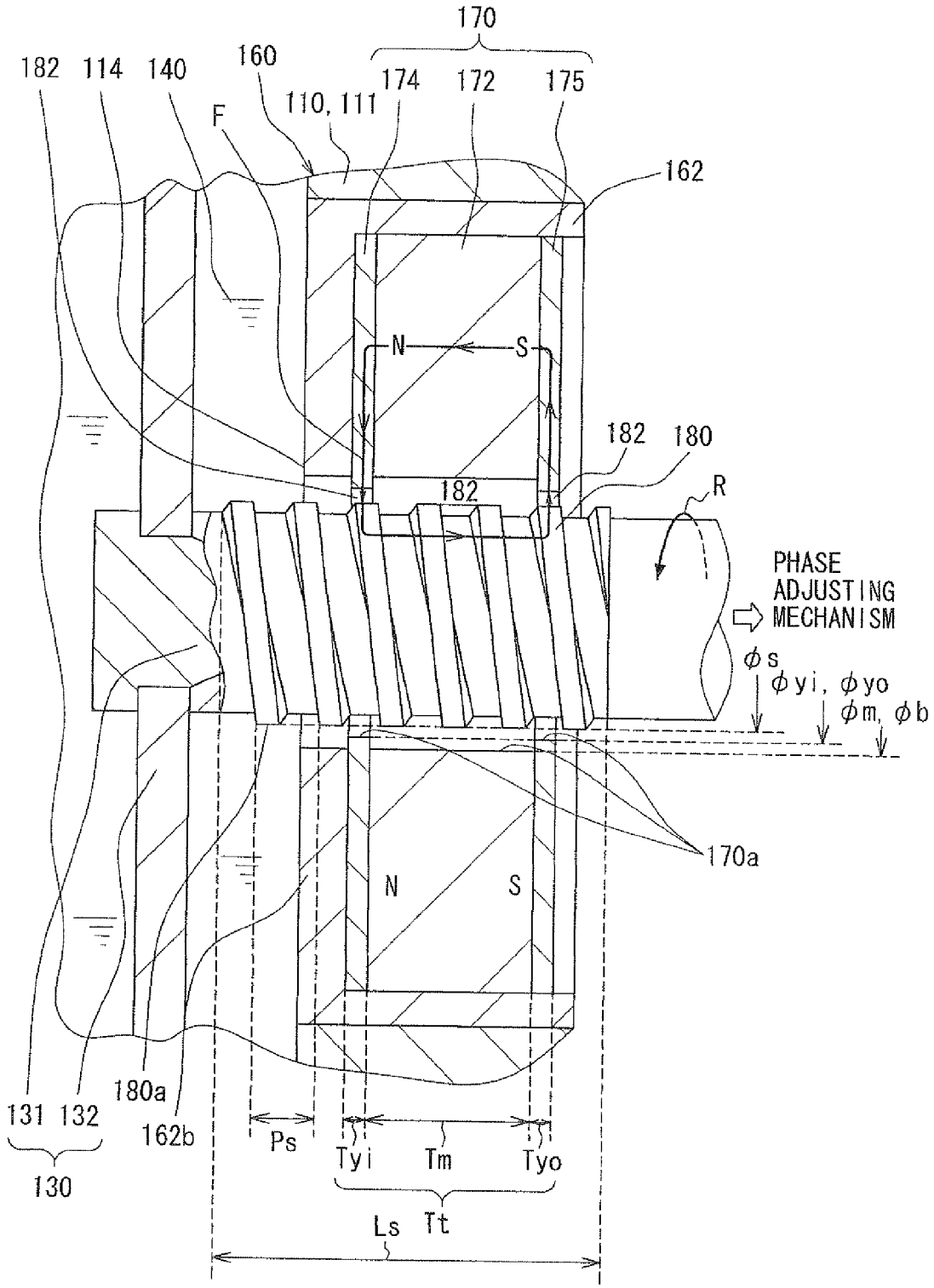
FIG. 7 is an enlarged cross-sectional view illustrating an actuator of the valve timing adjusting device of FIG. 5.

As shown in FIGS. 5 and 6, the magnetic sleeve section 170 is formed in the shape continuous in the rotational direction R of the brake rotor 130 as a whole and has a cylindrical permanent magnet 172 and a pair of magnetic yokes 174, 175. The permanent magnet 172 is made of a ferrite magnet or the like and is arranged on the outer peripheral side of the shaft section 131 of the brake rotor 130. The permanent magnet 172 has opposite magnetic poles N, S in both axial end portions thereof respectively as shown in FIG. 5 and invariably generates a magnetic flux F between the magnetic poles N, S (refer to FIG. 7). The permanent magnet 172 is fitted and fixed to an inner peripheral section of a peripheral wall section 162*c* of the shield section 162 coaxially with the shaft section 131. Thus, the permanent magnet 172 is provided to the housing 110 through the shield section 162. With such the construction, the nonmagnetic shield section 162 can exert a function to concentrate the magnetic flux F generated by the permanent magnet 172 toward the inner peripheral side without leaking the magnetic flux F to the fluid chamber 114 side as shown in FIG. 7.

As shown in FIGS. 5 and 6, the magnetic yokes 174, 175 are formed in the shape of annular plates from a magnetic material such as carbon steel, for example. The magnetic yokes 174, 175 are arranged on the outer peripheral side of the shaft section 131 of the brake rotor 130. The magnetic yokes 174, 175 are fitted and fixed to the inner peripheral section of the peripheral wall section 162*c* of the shield section 162 such that the magnetic yokes 174, 175 are coaxially adjacent to both of the axial end portions of the permanent magnet 172 respectively. Thus, the magnetic yokes 174, 175 are provided to the housing 110 through the shield section 162. With the above construction, the magnetic yokes 174, 175 can exert a function to concentrate and guide the magnetic flux F generated by the permanent magnet 172 toward the inner peripheral side as shown in FIG. 7.

Internal diameters $\phi yi$, $\phi yo$ of the magnetic yokes 174, 175 are set substantially equal to each other and smaller than an internal diameter $\phi m$ of the permanent magnet 172. In addition, axial thicknesses Tyi, Tyo of the magnetic yokes 174, 175 are set smaller than an axial thickness Tm of the permanent magnet 172. With such the size configuration, inside an inner peripheral section 170*a* of the magnetic sleeve section 170, an axially-middle portion provided by the permanent magnet 172 extends straight in the axial direction and is recessed further than the both axial end portions defined by the magnetic yokes 174, 175 into the shape of an annular groove. In the present embodiment, the smallest internal diameter $\phi b$ of the bottom portion 162*b* of the shield section 162 adjacent to the magnetic yoke 174 is set larger than the internal diameter $\phi yi$ of the yoke 174. For example, the smallest internal diameter $\phi b$ of the bottom portion 162*b* is set substantially equal to the internal diameter $\phi m$ of the permanent magnet 172.

As shown in FIG. 5, the magnetic screw section 180 is provided coaxially with the elements 172, 174, 175 at a position on the outer peripheral section of the shaft section 131, which is made of a metal exhibiting magnetism such as chrome molybdenum steel, of the brake rotor 130 radially inside the magnetic sleeve section 170. The magnetic screw section 180 has an external screw shape (right-hand external screw shape in FIG. 5) having a screw thread 180*a*, which extends away from the fluid chamber 114 side in the housing 110 toward the phase adjusting mechanism 300 side outside the housing 110 when the screw thread 180*a* is traced along the rotational direction R of the brake rotor 130 (clockwise direction when seen from left side of FIG. 5). The magnetic screw section 180 according to the present embodiment is formed, for example, by applying a cutting process to the shaft section 131 into the shape of an external screw of a parallel screw type, whose screw thread 180*a* has an external diameter $\phi s$ substantially constant in an entire axial range extending from the fluid chamber 114 side to the phase adjusting mechanism 300 side as shown in FIG. 7. A cross-sectional shape of the screw thread 180*a* of the magnetic screw section 180 along the axial direction is formed substantially in a trapezoidal shape in the present embodiment. Alternatively, the cross-sectional shape may be formed in the shape of a triangle, for example.

An external diameter cps of the screw thread 180*a* of the magnetic screw section 180 in the shape of the external screw is set smaller than the internal diameters $\phi yi$, $\phi yo$ of the magnetic yokes 174, 175, which are the smallest internal diameters in the inner peripheral section 170*a* of the magnetic sleeve section 170. With such the size configuration, the magnetic screw section 180 defines a sealing gap 182 in the radial direction between the magnetic screw section 180 and the inner peripheral section 170*a* of the magnetic sleeve section 170. The magnetic flux F generated by the permanent magnet 172 is guided through the gaps 182 between the magnetic screw section 180 and the magnetic yokes 174, 175. Therefore, in the sealing structure 160, the magnetic flux F invariably circulates through the magnetic yoke 174 on the fluid chamber 114 side, the magnetic screw section 180 and the magnetic yoke 175 on the phase adjusting mechanism 300 side.

Moreover, in the present embodiment, axial length Ls of the magnetic screw section 180 is set larger than total axial thickness Tt (=Tyi+Tm+Tyo) of the magnetic sleeve section 170. With such the size configuration, the magnetic screw section 180 is arranged to bridge both of the magnetic yokes 174, 175 along the axial direction radially inside the magnetic yokes 174, 175. In the present embodiment, a pitch Ps of the screw thread 180*a* of the magnetic screw section 180 is set such that both of the axial thicknesses Tyi, Tyo of the magnetic yokes 174, 175 are smaller than the pitch Ps.

With the sealing structure 160 having the above construction, the magnetic flux F generated by the permanent magnet 172 in the magnetic sleeve section 170 is guided to the sealing gaps 182 formed between the magnetic yokes 174, 175 and the magnetic screw section 180. As a result, because of the magnetic attraction applied to the magnetic particulates in the magnetic viscous fluid 140, the magnetic viscous fluid 140 easily flows from the fluid chamber 114 inside the housing 110 communicating with the sealing gaps 182 into the sealing gaps 182, through which the magnetic flux F passes. Moreover, the magnetic flux F passing through the sealing gaps 182 is guided in the concentrated manner from the magnetic yokes 174, 175 having the axial thicknesses Tyi, Tyo smaller than the pitch Ps of the magnetic screw section 180, whereby a passage density of the magnetic flux F is increased. Accordingly, the viscosity of the magnetic viscous fluid 140 flowing into the sealing gaps 182 increases easily.

Therefore, the magnetic viscous fluid 140, whose viscosity has been increased by the inflow into the sealing gaps 182, is trapped in the form of membranes between the inner peripheral section 170*a* of the magnetic sleeve section 170 at the magnetic yokes 174, 175 and the screw thread 180*a* of the magnetic screw section 180, thereby forming sealing membranes. The sealing membrane formed by the magnetic viscous fluid 140 in such the way is free from wear due to friction resistance. The sealing membrane can exert a self-sealing function to suppress the leakage of the magnetic viscous fluid 140 toward the phase adjusting mechanism 300 side outside the housing 110 by itself (i.e., by magnetic viscous fluid 140). The magnetic screw section 180 bridging the magnetic yokes 174, 175 along the axial direction radially inside the magnetic yokes 174, 175 can face the magnetic yokes 174, 175 even if the magnetic screw section 180 deviates in the axial direction from its regular position. With such the construction, the self-sealing function can be invariably exerted in the sealing gaps 182 between the magnetic yokes 174, 175 and the magnetic screw section 180.

In addition, the magnetic screw section 180 has the external screw shape with the screw thread, which extends away from the fluid chamber 114 side toward the phase adjusting mechanism 300 side when the screw thread is traced along the rotational direction R of the brake rotor 130. Therefore, the magnetic screw section 180 can apply a moment, which heads toward the fluid chamber 114 side, to the magnetic viscous fluid 140 over the entire range of the sealing gap 182 (i.e., over entire axial range of inner peripheral side of magnetic sleeve section 170 including magnetic yokes 174, 175). It is exertion of a screw-type rotational labyrinth sealing function, which is a combination of a hydrodynamic effect to draw the magnetic viscous fluid 140 from the phase adjusting mechanism 300 side outside the housing 110 (as low-pressure side) toward the fluid chamber 114 side inside the housing 110 (as high-pressure side) in accordance with the rotation speed of the brake rotor 130 (i.e., circumferential velocity of magnetic screw section 180) and the viscosity effect corresponding to the above-mentioned viscosity increase. Therefore, during the operation of the internal combustion engine, in which the brake rotor 130 rotates in the constant direction R, the magnetic viscous fluid 140 can be pushed back toward the fluid chamber 114 side against the leak flow toward the phase adjusting mechanism 300 side with such the labyrinth sealing function.

In addition, the labyrinth function can be exerted to the nonmagnetic base liquid in the magnetic viscous fluid 140 in addition to the magnetic particulates in the magnetic viscous fluid 140. Therefore, also the nonmagnetic base liquid separated from the magnetic particulates, which forms the sealing membrane, can be pushed back toward the fluid chamber 114 side. Moreover, as a secondary effect of the labyrinth function, the magnetic viscous fluid 140 is agitated in the sealing gap 182, local degradation of the magnetic viscous fluid 140 can be also avoided.

Thus, as the result of the exertion of the self-sealing function and the labyrinth sealing function, the durability can be secured by avoiding the wear and the degradation and the high reliability can be secured by avoiding the change in the input characteristics of the brake torque due to the leakage of the magnetic viscous fluid 140 at the same time. In the above-described first embodiment, the solenoid coil 150 and the energization control circuit 200 constitute the viscosity controlling section in combination.

Second Embodiment

Figure 8:
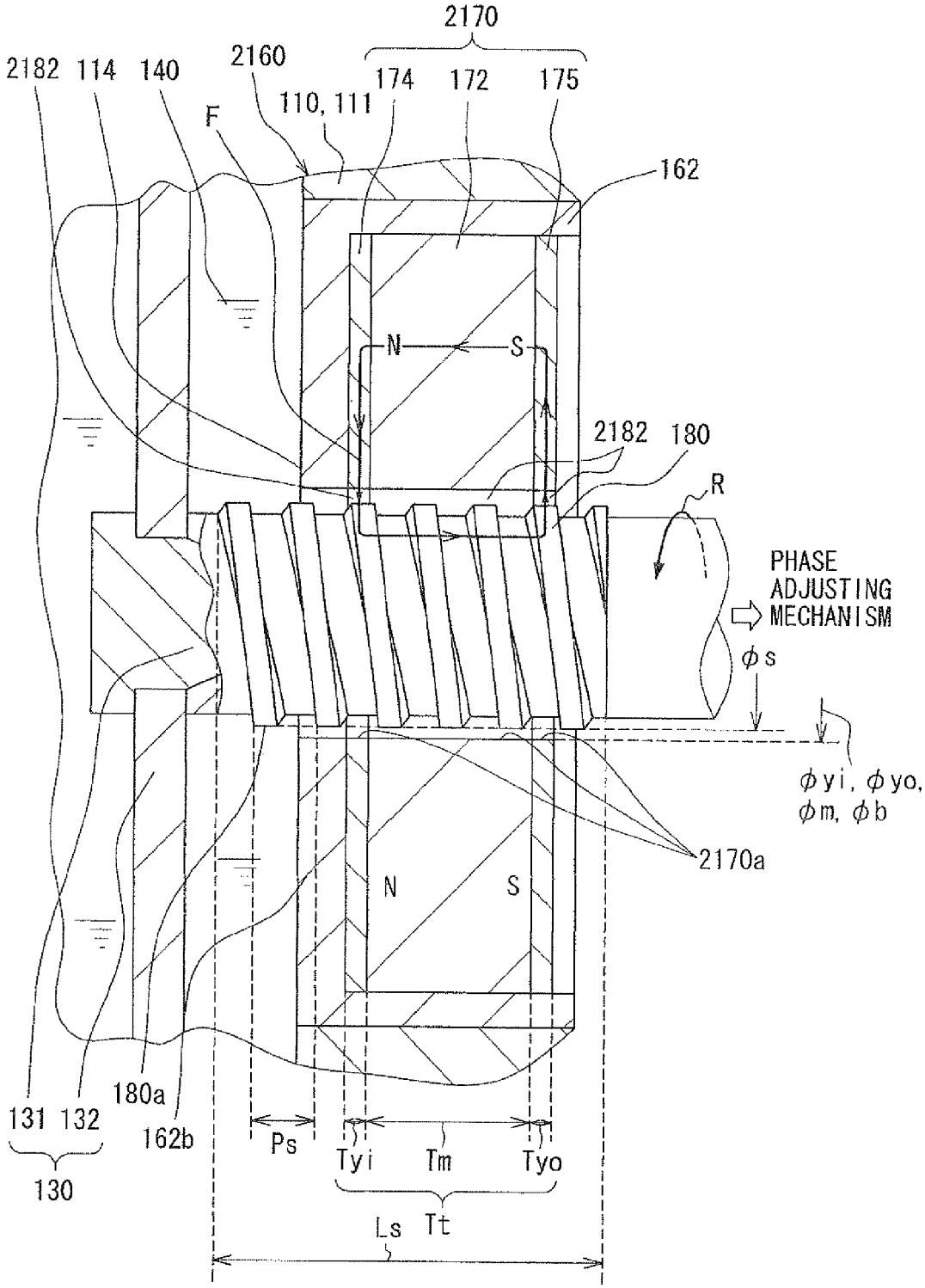
FIG. 8 is an enlarged cross-sectional view showing a substantial part of an actuator of a valve timing adjusting device according to a second embodiment of the present invention.

Next, a second embodiment of the present invention will be explained. As shown in FIG. 8, the second embodiment is a modified example of the first embodiment. In a sealing structure 2160 according to the second embodiment, a sealing gap 2182 is provided between an inner peripheral section 2170*a* of a magnetic sleeve section 2170 and the magnetic screw section 180 of the parallel screw type. The inner peripheral section 2170*a* of the magnetic sleeve section 2170 extends straight from its end portion on the phase adjusting mechanism 300 side to its other end portion on the fluid chamber 114 side.

More specifically, the internal diameters ϕyi, ϕyo of the magnetic yokes 174, 175 defining both of the axial end portions of the magnetic sleeve section 2170 are set substantially equal to each other and substantially equal to the internal diameter ϕm of the permanent magnet 172. With such the size configuration, the inner peripheral section 2170*a* of the permanent magnet 172 having the internal diameter ϕm in the magnetic sleeve section 2170 is arranged as close as possible to the screw thread 180*a* of the magnetic screw section 180 having the external diameter ϕs smaller than the internal diameters ϕyi, ϕyo of the magnetic yokes 174, 175. As a result, the narrow sealing gap 2182 (e.g., approximately 0.05 to 0.2 mm) can be formed between the inner peripheral section 2170*a* of the magnetic sleeve section 2170, which extends straight throughout its entire axial range, and the screw thread 180*a* of the magnetic screw section 180 over a range corresponding to the entire axial range of the inner peripheral section 2170*a*. In such the second embodiment, the smallest internal diameter ϕb of the bottom portion 162*b* of the shield section 162 adjacent to the magnetic yoke 174 is set equal to or larger than the internal diameter ϕyi of the yoke 174. In the example of FIG. 8, the internal diameter ϕb of the bottom portion 162*b* of the shield section 162 is set substantially equal to the internal diameter ϕyi of the yoke 174.

The labyrinth sealing function (specifically, high viscosity effect) can be heightened in the sealing gap 2182, which is kept narrow over the longest range between the magnetic screw section 180 and the magnetic sleeve section 2170 as explained above. Accordingly, the magnetic viscous fluid 140 can be pushed back to the fluid chamber 114 side more easily during the operation of the internal combustion engine. Moreover, the magnetic yoke 174 defining the end portion of the magnetic sleeve section 2170 on the fluid chamber 114 side, toward which the magnetic viscous fluid 140 is pushed back, has the inner peripheral section 2170*a* having the internal diameter substantially equal to the other part of the magnetic sleeve section 2170 (i.e., permanent magnet 172 and magnetic yoke 175). Therefore, the magnetic yoke 174 does not block the pushing back of the magnetic viscous fluid 140. Accordingly, the magnetic viscous fluid 140 receiving the action of the labyrinth sealing function in the sealing gap 2182 can be pushed back to the fluid chamber 114 smoothly. With such the construction, the change in the input characteristics of the brake torque due to the leakage of the magnetic viscous fluid 140 can be surely avoided, and the high reliability can be secured.

Figure 9:
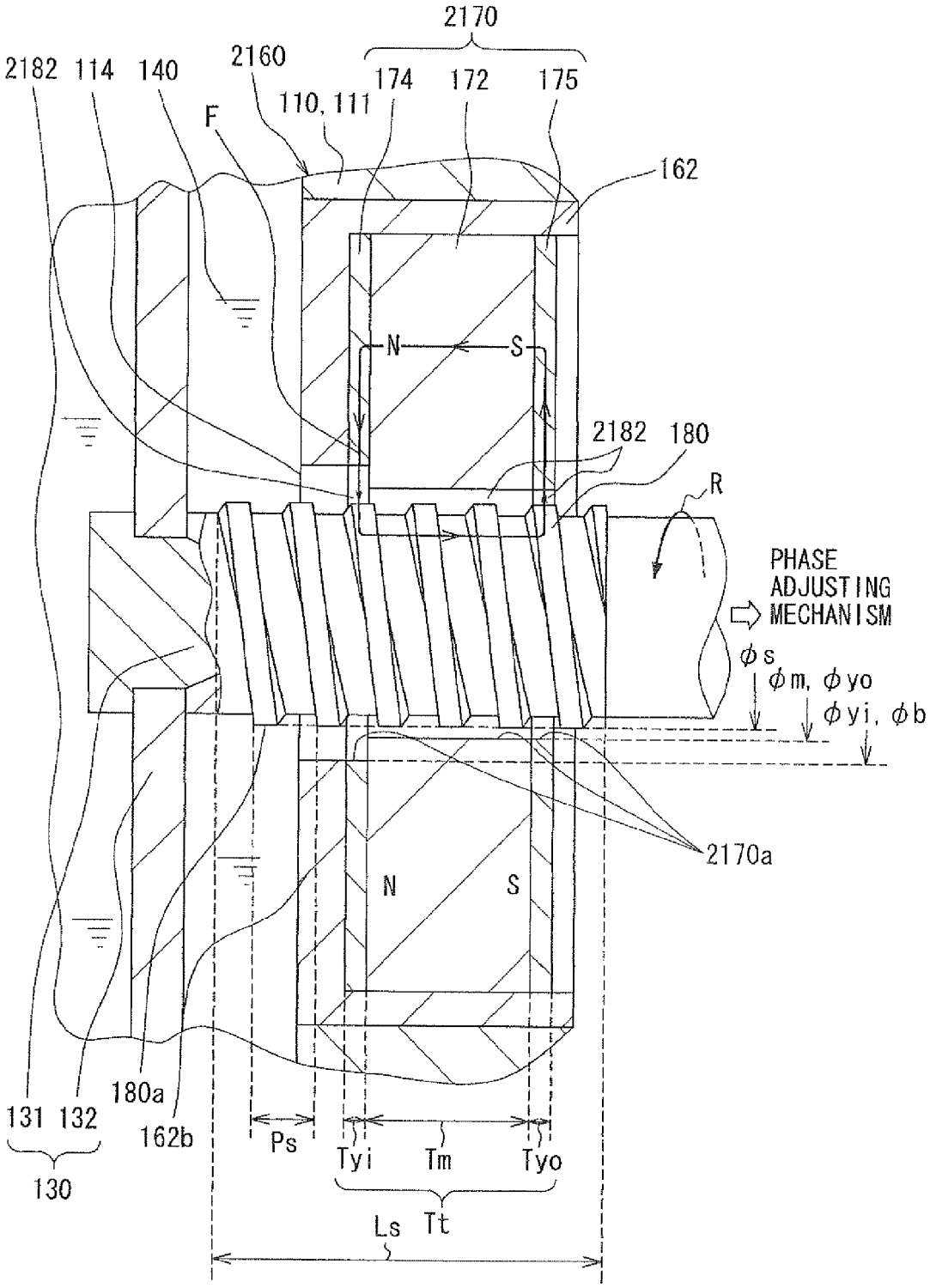
FIG. 9 is an enlarged cross-sectional view showing a modified example of the actuator of the valve timing adjusting device of FIG. 8.

A modified example is shown in FIG. 9. As shown in FIG. 9, the internal diameter ϕyi of the magnetic yoke 174 defining the end portion of the magnetic sleeve section 2170 on the fluid chamber 114 side and the smallest internal diameter ϕb of the bottom portion 162*b* of the shield section 162 may be set larger than the internal diameters ϕm, ϕyo of the permanent magnet 172 and the magnetic yoke 175. With such the size configuration, the inner peripheral section 2170*a* of the magnetic sleeve section 2170 extends straight in the axial direction from its end portion on the phase adjusting mechanism 300 side toward the fluid chamber 114 side. Therefore, the narrow sealing gap 2182 can be secured over a relatively long range excluding the end portion on the fluid chamber 114 side.

Third Embodiment

Figure 10:
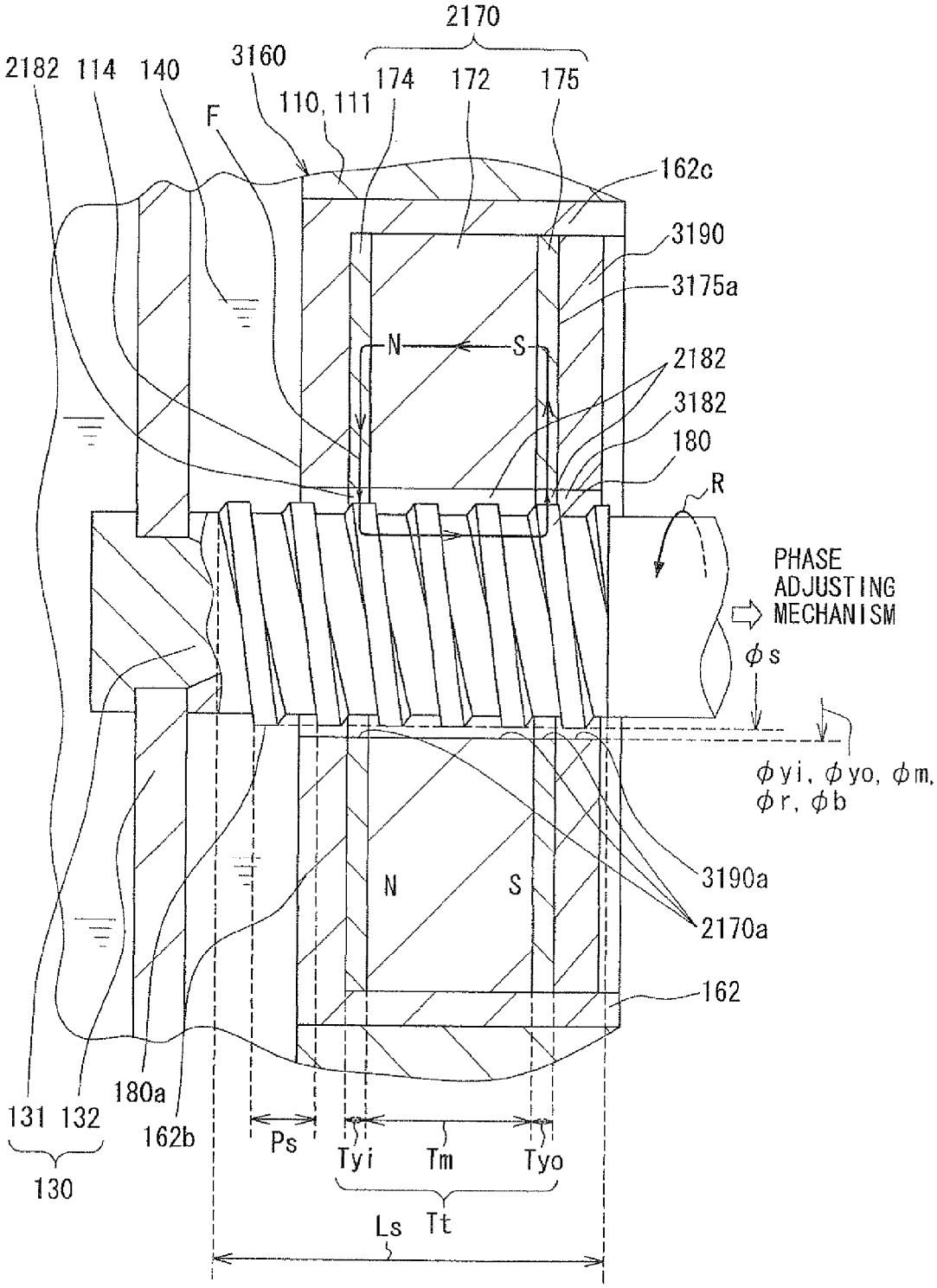
FIG. 10 is an enlarged cross-sectional view showing a substantial part of an actuator of a valve timing adjusting device according to a third embodiment of the present invention.

Next, a third embodiment of the present invention will be explained. As shown in FIG. 10, the third embodiment is a modified example of the second embodiment. A sealing structure 3160 according to the third embodiment further has a nonmagnetic annular section 3190 that is arranged on the phase adjusting mechanism 300 side of the magnetic sleeve section 2170 and that surrounds the outer peripheral side of the magnetic screw section 180.

More specifically, the nonmagnetic annular section 3190 in the shape of an annular plate is made of a nonmagnetic material such as stainless steel and is arranged on the outer peripheral side of the magnetic screw section 180 provided to the shaft section 131 of the brake rotor 130. The nonmagnetic annular section 3190 is fitted and fixed to the inner peripheral section of the peripheral wall section 162*c* of the shield section 162 such that the nonmagnetic annular section 3190 is coaxially adjacent to the magnetic yoke 175, which defines the end portion of the magnetic sleeve section 2170 on the phase adjusting mechanism 300 side. Thus, the nonmagnetic annular section 3190 is provided to the housing 110 through the shield section 162. With such the construction, the nonmagnetic annular section 3190 can suppress the leakage of the magnetic flux F, which is guided between the magnetic yoke 175 and the magnetic screw section 180, from an axial end surface 3175*a* of the yoke 175 opposite from the permanent magnet 172 toward the phase adjusting mechanism 300 side.

An internal diameter ϕr of the nonmagnetic annular section 3190 is set substantially equal to the internal diameters ϕm, ϕyi, ϕyo of the elements 172, 174, 175 of the magnetic sleeve section 2170. With such the size configuration, an inner peripheral section 3190*a* of the nonmagnetic annular section 3190 and the inner peripheral section 2170*a* of the magnetic sleeve section 2170 are arranged as close as possible to the screw thread 180*a* of the magnetic screw section 180, which has the external diameter cps smaller than the internal diameters ϕyi, ϕyo of the magnetic yokes 174, 175. As a result, a gap 3182 communicating with the sealing gap 2182 in the axial direction can be formed between the nonmagnetic annular section 3190 and the magnetic screw section 180.

Thus, in the gap 3182 secured between the nonmagnetic annular section 3190 on the phase adjusting mechanism 300 side of the magnetic sleeve section 2170 and the magnetic screw section 180, the labyrinth sealing function similar to the case of the sealing gap 2182 can be exerted during the operation of the internal combustion engine. Therefore, even if the magnetic viscous fluid 140 leaks from the sealing gap 2182 toward the phase adjusting mechanism 300 side, the magnetic viscous fluid 140 can be pushed back to the sealing gap 2182 by the labyrinth function in the gap 3182 on the phase adjusting mechanism 300 side. Moreover, the magnetic flux F of the permanent magnet 172 is less apt to leak from the end surface 3175*a* of the magnetic sleeve section 2170 toward the phase adjusting mechanism 300 side because of the nonmagnetic annular section 3190. Accordingly, the magnetic flux F generated by the permanent magnet 172 can be surely guided to the sealing gap 2182 and also the magnetic particulates in the magnetic viscous fluid 140 do not stick to the end surface 3175*a* of the magnetic sleeve section 2170. Therefore, the self-sealing function improves. With such the construction, the change in the input characteristics of the brake torque due to the leakage of the magnetic viscous fluid 140 can be surely avoided, thereby securing the high reliability.

The internal diameter ϕr of the nonmagnetic annular section 3190 may be set smaller than the internal diameter ϕyo of the magnetic yoke 175 adjacent to the nonmagnetic annular section 3190 in the axial direction such that the nonmagnetic annular section 3190 protrudes toward the inner peripheral side more than the magnetic yoke 175. Thus, the labyrinth sealing function in the gap 3182 may be heightened. Alternatively, the internal diameter ϕr of the nonmagnetic annular section 3190 may be set larger than the internal diameter ϕyo of the magnetic yoke 175.

Fourth Embodiment

Figure 11:
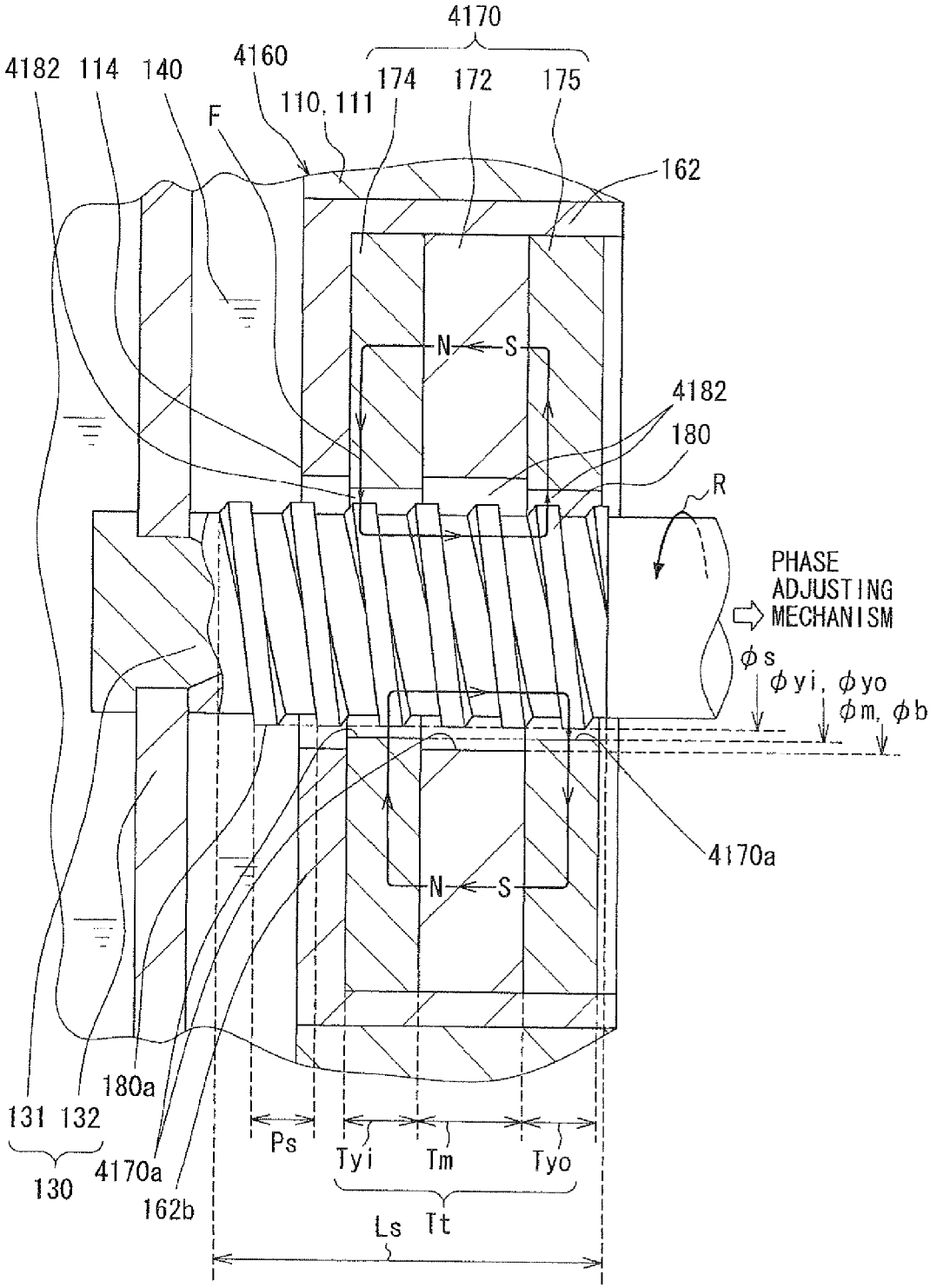
FIG. 11 is an enlarged cross-sectional view showing a substantial part of an actuator of a valve timing adjusting device according to a fourth embodiment of the present invention.

Next, a fourth embodiment of the present invention will be explained. As shown in FIG. 11, the fourth embodiment is a modified example of the first embodiment. In a sealing structure 4160 according to the fourth embodiment, axial thicknesses Tyi, Tyo of magnetic yokes 174, 175 of a magnetic sleeve section 4170 are set to be equal to or larger than the pitch Ps of the screw thread 180*a* of the magnetic screw section 180. With such the size configuration, the screw thread 180*a* of the magnetic screw section 180 radially overlaps with an inner peripheral section 4170*a* of the magnetic sleeve section 4170 in each of the magnetic yokes 174, 175 over a range equal to or larger than a range of one round of the screw thread 180*a* traced along the rotational direction R of the brake rotor 130.

As the result of such the overlap, in a predetermined longitudinal cross-section of the brake rotor 130 along the axial direction (cross-section shown in FIG. 11), each of the magnetic yokes 174, 175 faces the multiple (two in FIG. 11) points of the screw thread 180*a* of the magnetic screw section 180 respectively. Thus, multiple stages of the sealing membranes can be formed in a sealing gap 4182. By forming the multiple stages of the sealing membranes in this way, total pressure resistance of the entire membranes and the eventual total self-sealing function of the entire membranes improve. Accordingly, the change in the input characteristics of the brake torque due to the leakage of the magnetic viscous fluid 140 can be surely avoided, and the high reliability can be secured.

Fifth Embodiment

Figure 12:
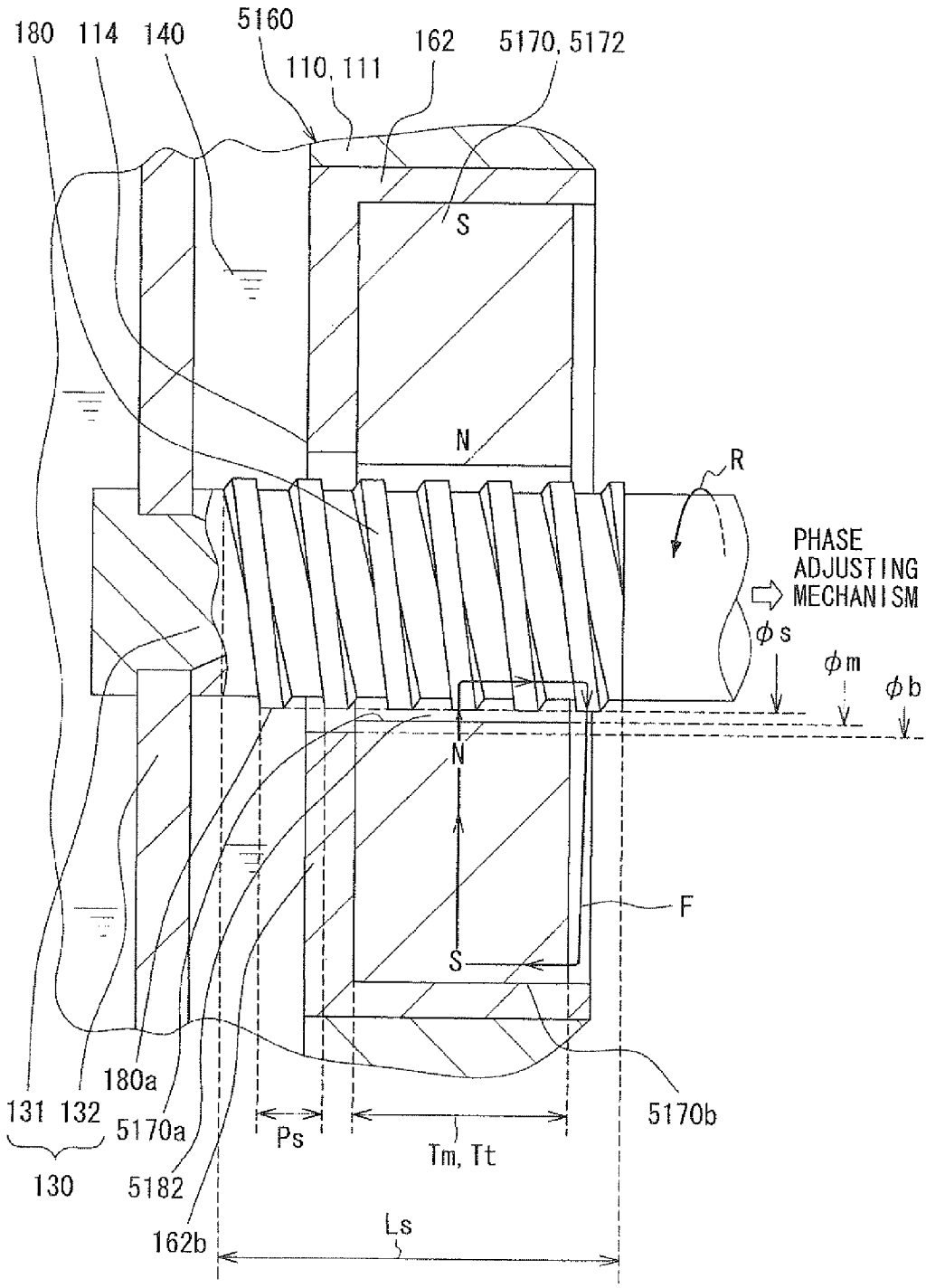
FIG. 12 is an enlarged cross-sectional view showing a substantial part of an actuator of a valve timing adjusting device according to a fifth embodiment of the present invention.

Next, a fifth embodiment of the present invention will be explained. As shown in FIG. 12, the fifth embodiment is a modified example of the first embodiment. In a sealing structure 5160 according to the fifth embodiment, a magnetic sleeve section 5170 does not have magnetic yokes 174, 175. Therefore, a permanent magnet 5172 provides the entirety of the magnetic sleeve section 5170 and forms opposite magnetic poles N, S over entire axial ranges of an inner peripheral section 5170*a* and an outer peripheral section 5170*b* of the magnetic sleeve section 5170.

An internal diameter ϕm of the permanent magnet 5172 is set larger than an external diameter ϕs of the magnetic screw section 180, thereby forming a sealing gap 5182 for guiding the generated magnetic flux F between the permanent magnet 5172 and the magnetic screw section 180. In such the fifth embodiment, the smallest internal diameter ϕb of the bottom portion 162*b* of the shield section 162 adjacent to the permanent magnet 5172 is set equal to or larger than the internal diameter ϕm of the magnet 5172. In the example of FIG. 12, the smallest internal diameter ϕb is set substantially equal to the internal diameter ϕm. As for other constructions of the permanent magnet 5172 than the construction explained above, the permanent magnet 5172 has the construction similar to that of the permanent magnet 172 of the first embodiment.

In such the sealing structure 5160, the magnetic flux F is guided from the entire axial range of the inner peripheral section 5170*a* of the permanent magnet 5172 in the magnetic sleeve section 5170 to the magnetic screw section 180 through the sealing gap 5182. With such the guiding action, the viscosity increase of the magnetic viscous fluid 140 due to the passage of the magnetic flux F occurs in the sealing gap 5182 in the range corresponding to the entire axial range of the magnetic sleeve section 5170. Accordingly, the labyrinth sealing function as the combination of the viscosity effect and the hydrodynamic effect can be heightened. Therefore, the change in the input characteristics of the brake torque due to the leakage of the magnetic viscous fluid 140 can be avoided, and the reliability can be secured.

Other Embodiments

The present invention is not limited to the above-described embodiments. The present invention can be applied to other various embodiments and various combinations of the embodiments.

Figure 13:
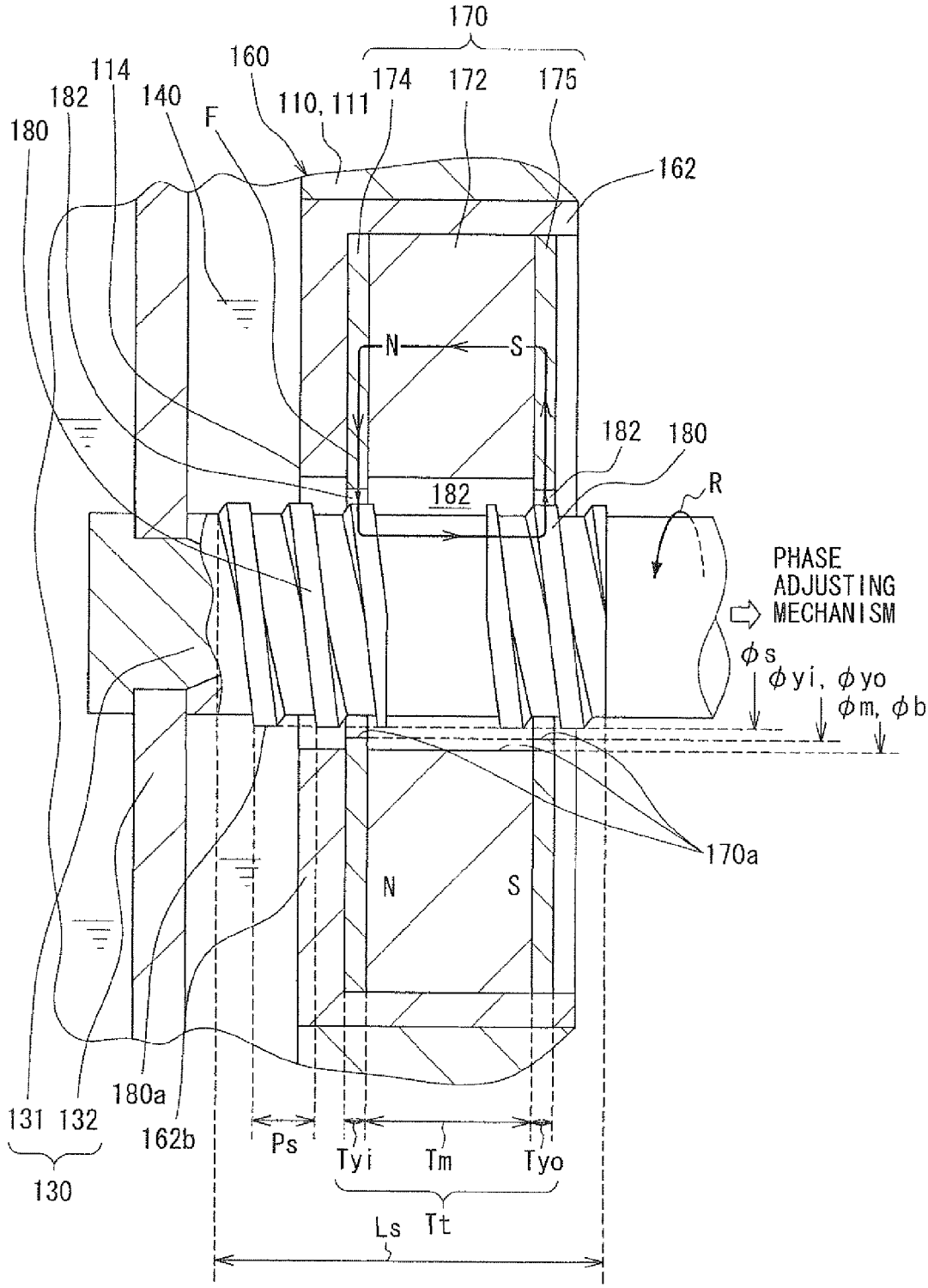
FIG. 13 is an enlarged cross-sectional view showing a modified example of the actuator of the valve timing adjusting device of FIG. 7.

For example, in the first to fifth embodiments, if the rotational direction R of the brake rotor 130 is opposite to the direction shown in FIG. 5 or other corresponding drawings (i.e., if rotational direction R is counterclockwise direction when seen from left side of FIG. 5 or other corresponding drawings), the spiral direction of the magnetic screw section 180 in the shape of the external screw may be set to be opposite to FIG. 5 or other corresponding drawings. That is, the spiral direction of the magnetic screw section 180 may be a direction of a left-hand screw. In the first to fifth embodiments, the polarities of the respective magnetic poles of each of the permanent magnets 172, 5172 of the magnetic sleeve sections 170, 2170, 4170, 5170 may be set opposite to that of FIG. 5 or other corresponding drawings. In the first to fifth embodiments, a magnetic screw section may be formed on the brake rotor 130 as a conical screw type, in which an external diameter ϕs of a screw thread 180*a* reduces from one side to the other side of the fluid chamber 114 side and the phase adjusting mechanism 300 side in the axial direction. In the first to fourth embodiments, as shown in a modified example of FIG. 13 (which is modified example of first embodiment), the magnetic screw section 180 may be separated to positions bridging the magnetic yokes 174, 175 of each of the magnetic sleeve sections 170, 2170, 4170 respectively along the axial direction.

In the first and third embodiments, the magnetic yokes 174, 175 may not be provided to the magnetic sleeve sections 170, 2170. In this case, in the third embodiment, the nonmagnetic annular section 3190 may be arranged coaxially adjacent to the end surface of the permanent magnet 172 on the phase adjusting mechanism 300 side. In the first and fourth embodiments, another member such as a reinforcement member may be provided on the inner peripheral side of the permanent magnet 172 of each of the magnetic sleeve sections 170, 4170 such that the internal diameter of the end portion of each of the magnetic sleeve sections 170, 4170 on the fluid chamber 114 side is set equal to or larger than the internal diameter of the other part including the another member as in the second embodiment or the modified example of the second embodiment. In the second embodiment or the modified example of the second embodiment, the internal diameter of the end portion of the permanent magnet 172, which provides the entire magnetic sleeve section 2170 when the magnetic yokes 174, 175 are not used, on the fluid chamber 114 side may be set equal to or larger than the internal diameter of the other part.

Arbitrary structure may be employed as the structure of the phase adjusting mechanism 300 according to the first to fifth embodiments within a range where the engine phase can be adjusted in accordance with the brake torque inputted to the brake rotor 130 in conjunction with the brake rotor 130. The present invention may be implemented by reversing the relationship between the advance and the delay or the relationship between the clockwise direction and the counterclockwise direction of the first to the fifth embodiments. The present invention is not limited to the application to the device that adjusts the valve timing of the intake valve as the actuated valve. Alternatively, the present invention may be applied to a device that adjusts valve timing of an exhaust valve as an actuated valve or a device that adjusts the valve timings of both of the intake valve and the exhaust valve.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A valve timing adjusting device for adjusting valve timing of an actuated valve, which is opened and closed by a camshaft using torque transmitted from a crankshaft, in an internal combustion engine, the valve timing adjusting device comprising:

a housing defining a fluid chamber inside;

a magnetic viscous fluid that is sealed in the fluid chamber and that has viscosity changing in accordance with a magnetic flux passing through the fluid;

a viscosity controlling means for variably controlling the viscosity of the magnetic viscous fluid by passing the magnetic flux through the magnetic viscous fluid in the fluid chamber;

a brake rotor that penetrates through the housing between an inside and an outside of the housing and that rotates in a constant direction due to an operation of the internal combustion engine, wherein brake torque corresponding to the viscosity of the magnetic viscous fluid in the fluid chamber is inputted to the brake rotor through contact between the brake rotor and the magnetic viscous fluid;

a phase adjusting mechanism that is linked with the brake rotor outside the housing and that adjusts a relative phase between the crankshaft and the camshaft in accordance with the brake torque inputted to the brake rotor; and a sealing structure for sealing a clearance between the housing and the brake rotor, wherein the sealing structure has:

a magnetic sleeve section that is provided in the housing to be continuous in the rotational direction of the brake rotor and that generates the magnetic flux; and a magnetic screw section that is provided to the brake rotor such that a sealing gap is formed between the magnetic screw section and an inner peripheral section of the magnetic sleeve section and that is formed in the shape of an external screw having a screw thread, which extends away from the fluid chamber side toward the phase adjusting mechanism side when the screw thread is traced along the rotational direction of the brake rotor, wherein the magnetic flux generated by the magnetic sleeve section is guided to the magnetic screw section through the sealing gap, and the magnetic sleeve section has:

a cylindrical permanent magnet that is provided coaxially with the magnetic screw section and that generates the magnetic flux using magnetic poles formed by both axial end portions thereof; and a pair of magnetic yokes in the shape of annular plates that are coaxially adjacent to the both axial end portions of the permanent magnet respectively and that guide the magnetic flux generated by the permanent magnet to the sealing gap between the magnetic sleeve section and the magnetic screw section.

2. The valve timing adjusting device as in claim 1, wherein the magnetic viscous fluid sealed in the fluid chamber is prepared by dispersing magnetic particulates in a nonmagnetic base liquid.

3. The valve timing adjusting device as in claim 1, wherein the magnetic screw section is a parallel screw type, the inner peripheral section of the magnetic sleeve section, which forms the sealing gap with the magnetic screw section, extends straight in an axial direction from its first axial end portion on a phase adjusting mechanism side toward a fluid chamber side, and an internal diameter of a second axial end portion of the inner peripheral section on the fluid chamber side is set equal to or larger than an internal diameter of the other portion of the inner peripheral section.

4. The valve timing adjusting device as in claim 3, wherein the inner peripheral section of the magnetic sleeve section, which forms the sealing gap with the magnetic screw section of the parallel screw type, extends straight over an entire axial range extending from its first axial end portion on the phase adjusting mechanism side to its second axial end portion on the fluid chamber side.

5. The valve timing adjusting device as in claim 1, wherein the sealing structure has a nonmagnetic annular section that is coaxially adjacent to an axial end portion of the magnetic sleeve section on the phase adjusting mechanism side and that surrounds an outer peripheral side of the magnetic screw section.

6. The valve timing adjusting device as in claim 1, wherein the magnetic screw section is arranged over a range bridging the magnetic yoke along the axial direction radially inside the magnetic yoke.

7. The valve timing adjusting device as in claim 1, wherein the magnetic yoke has axial thickness smaller than a pitch of the magnetic screw section.

8. The valve timing adjusting device as in claim 1, wherein the magnetic yoke has axial thickness equal to or larger than a pitch of the magnetic screw section.

* * * * *